US011396108B2

(12) United States Patent
Baxter et al.

(10) Patent No.: US 11,396,108 B2
(45) Date of Patent: Jul. 26, 2022

(54) APPARATUSES FOR CUTTING FOOD PRODUCTS AND METHODS FOR OPERATING THE SAME

(71) Applicants: Urschel Laboratories, Inc., Chesterton, IN (US); Frito-Lay North America, Inc., Plano, TX (US)

(72) Inventors: Corey Everette Baxter, Valparaiso, IN (US); Michael Scot Jacko, Valparaiso, IN (US); Keith Alan Barber, Plano, TX (US); Richard James Ruegg, Plano, TX (US); Daniel Wade King, Valparaiso, IN (US)

(73) Assignees: Urschel Laboratories, Inc., Chesterton, IN (US); Frito-Lay North America, Inc., Plano, TX (US)

( * ) Notice: Subject to any disclaimer, the term of this patent is extended or adjusted under 35 U.S.C. 154(b) by 284 days.

(21) Appl. No.: 16/735,845

(22) Filed: Jan. 7, 2020

(65) Prior Publication Data

US 2020/0223084 A1 Jul. 16, 2020

Related U.S. Application Data

(60) Provisional application No. 62/790,874, filed on Jan. 10, 2019.

(51) Int. Cl.
*B26D 1/03* (2006.01)
*B26D 7/06* (2006.01)
(Continued)

(52) U.S. Cl.
CPC ..... *B26D 1/03* (2013.01); *B26D 1/0006* (2013.01); *B26D 3/26* (2013.01); *B26D 7/0691* (2013.01);
(Continued)

(58) Field of Classification Search
CPC .... B26D 2210/02; B26D 1/03; B26D 1/0006; B26D 3/26; B26D 7/2628; B26D 7/2635;
(Continued)

(56) References Cited

U.S. PATENT DOCUMENTS 3,139,128 A 6/1964 Urschel et al.
3,139,129 A 6/1964 Urschel et al.
(Continued)

FOREIGN PATENT DOCUMENTS

EP 0495239 7/1992
EP 1918078 5/2008
(Continued)

OTHER PUBLICATIONS

International Search Report / Written Opinion for International Application No. PCT/US2020/012553, dated Mar. 30, 2020, (17 pages).
(Continued)

*Primary Examiner* — Jennifer S Matthews
(74) *Attorney, Agent, or Firm* — Hartman Global IP Law; Gary M. Hartman; Domenica N. S. Hartman

(57) ABSTRACT

Methods and apparatuses for cutting food products. The apparatus includes an annular-shaped cutting head having at least a first mounting frame surrounding a central axis of the cutting head and a plurality of cutting tools arranged around the central axis of the cutting head and pivotably coupled to the first mounting frame such that each cutting tool has a pivot axis. The method includes deflecting each cutting tool about its pivot axis by engaging first portions of the cutting tools in proximity to the first mounting frame to deflect the first portions a first radial deflection distance relative to the central axis and engaging second portions of the cutting tools to deflect the second portions a second radial deflection distance relative to the central axis. The first and second
(Continued)

radial deflection distances can be adjusted individually or in unison.

29 Claims, 21 Drawing Sheets

(51) Int. Cl.
*B26D 7/26* (2006.01)
*B26D 3/26* (2006.01)
*B26D 1/00* (2006.01)

(52) U.S. Cl.
CPC .... *B26D 7/2614* (2013.01); *B26D 2001/0033* (2013.01); *B26D 2210/02* (2013.01)

(58) Field of Classification Search
CPC ..... Y10T 83/6473; Y10T 83/6475; Y10T 83/9372; Y10T 83/9406; Y10T 83/932
See application file for complete search history.

(56) References Cited

U.S. PATENT DOCUMENTS

| | | | | |
|---|---|---|---|---|
| 4,604,925 | A | 8/1986 | Wisdom | |
| 5,095,875 | A * | 3/1992 | Morris | B26D 1/0006 83/404.3 |
| 5,163,563 | A | 11/1992 | Coppolani | |
| 5,555,787 | A * | 9/1996 | Barber | B26D 1/03 83/404.3 |
| 5,694,824 | A | 12/1997 | Jacko et al. | |
| 6,968,765 | B2 | 11/2005 | King | |
| 7,658,133 | B2 | 2/2010 | Jacko et al. | |
| 8,161,856 | B2 | 4/2012 | Jacko et al. | |
| 9,193,086 | B2 | 11/2015 | Jacko et al. | |
| 9,469,041 | B2 | 10/2016 | King et al. | |
| 2004/0237747 | A1 | 12/2004 | King | |
| 2014/0007751 | A1 | 1/2014 | Michel et al. | |
| 2014/0230621 | A1 | 8/2014 | Bucks | |
| 2014/0290451 | A1 | 10/2014 | Jacko et al. | |
| 2016/0075047 | A1 * | 3/2016 | Bucks | B26D 7/2614 83/403 |
| 2016/0361831 | A1 | 12/2016 | Fant | |
| 2018/0126581 | A1 | 5/2018 | Jacko | |
| 2018/0333886 | A1 * | 11/2018 | Gereg | B26D 1/0006 |

FOREIGN PATENT DOCUMENTS

| | | | | |
|---|---|---|---|---|
| EP | 3412418 | | 12/2018 | |
| EP | 3461605 | A1 * | 4/2019 | B26D 1/03 |
| JP | 2017108702 | | 6/2017 | |

OTHER PUBLICATIONS

International Search Report / Written Opinion for International Application No. PCT/US2020/012465, dated Apr. 28, 2020, (12 pages).

* cited by examiner

APPARATUSES FOR CUTTING FOOD PRODUCTS AND METHODS FOR OPERATING THE SAME

CROSS REFERENCE TO RELATED APPLICATIONS

This application claims the benefit of U.S. Provisional Application No. 62/790,874 filed Jan. 10, 2019. The contents of this prior application are incorporated herein by reference.

BACKGROUND

The present disclosure generally relates to methods and equipment for cutting food products.

Various types of equipment are known for cutting food products, such as vegetable, fruit, dairy, and meat products. This equipment may slice, shred, or otherwise prepare the food products for further processing. One type of slicing equipment is commercially available from Urschel Laboratories, Inc., under the name Urschel Model CC® machine line, which includes centrifugal-type slicers capable of uniformly slicing food products.

SUMMARY

The present disclosure provides a methods and apparatuses suitable for cutting food products.

According to one nonlimiting aspect of the disclosure, an apparatus for cutting food products includes an annular-shaped cutting head having at least a first mounting frame surrounding a central axis of the cutting head, and a plurality of cutting tools arranged around the central axis and pivotably coupled to the first mounting frame such that each of the cutting tools has a pivot axis. Means are provided for deflecting each of the cutting tools about the pivot axis thereof. The deflecting means comprise first deflecting units each coupled to the first mounting frame and engaging first portions of the cutting tools in proximity to the first mounting frame to deflect the first portions a first radial deflection distance relative to the central axis, and second deflecting units coupled to the second mounting frame and engaging second portions of the cutting tools to deflect the second portions a second radial deflection distance relative to the central axis. The second portions of the cutting tools engaged by the second deflecting units are spaced apart from the first portions of the cutting tools and are farther from the first mounting frame than the first portions such that the first and second deflecting units associated with one of the cutting tools make discontinuous contact with the cutting tool. Means are also provided for operating the first and second deflecting units to alter the first and second radial deflection distances of the first and second portions of the cutting tools, wherein the operating means are operable to alter the first radial deflection distances in unison with each other and the second radial deflection distances in unison with each other.

According to another nonlimiting aspect of the disclosure, an apparatus for cutting food products includes an annular-shaped cutting head having first and second mounting frames surrounding a central axis of the cutting head and spaced apart along the central axis, and a plurality of cutting tools arranged around the central axis and disposed between and pivotably coupled to the first and second mounting frames such that each of the cutting tools has a pivot axis. The cutting tools define sequential pairs of the cutting tools in which one of the cutting tools of each sequential pair is a leading cutting tool of the sequential pair and an adjacent one of the cutting tools is a trailing cutting tool of the sequential pair. Each cutting tool has a cutting blade positioned at a leading side of the cutting tool and a trailing edge positioned at a trailing side of the cutting tool opposite the leading side. The trailing edge of each leading cutting tool cooperates with the cutting blade of the trailing cutting tool thereof to define a cutting gap therebetween. The cutting tools each are rotatable about the pivot axes thereof between a first position in which the cutting gap has a first gap width and a second position in which the cutting gap has a second gap width that is different from the first gap. Means is provided for camming each of the cutting tools about the pivot axis thereof toward the second position thereof. The camming means includes first camming units each coupled to the first mounting frame and engaging first portions of the cutting tools in proximity to the first mounting frame to deflect the first portions a first radial deflection distance relative to the central axis, and second camming units coupled to the second mounting frame and engaging second portions of the cutting tools in proximity to the second mounting frame to deflect the second portions a second radial deflection distance relative to the central axis. The camming means further comprise means for maintaining engagement of the cutting tools with the first and second camming units and the first and second camming units serve as adjustable stops for the cutting tools. Means is provided for operating the first and second camming units to enable independent altering of the first and second radial deflection distances of the first and second portions of the cutting tools.

According to yet another nonlimiting aspect of the disclosure, a method for cutting food products includes operating an apparatus having an annular-shaped cutting head that comprises at least a first mounting frame surrounding a central axis of the cutting head and a plurality of cutting tools arranged around the central axis of the cutting head and pivotably coupled to the first mounting frame such that each of the cutting tools has a pivot axis. The method includes deflecting each of the cutting tools about the pivot axis thereof by engaging first portions of the cutting tools in proximity to the first mounting frame to deflect the first portions a first radial deflection distance relative to the central axis and separately engaging second portions of the cutting tools to deflect the second portions a second radial deflection distance relative to the central axis, and altering the first and second radial deflection distances of the first and second portions of the cutting tools, wherein the second portions of the cutting tools are spaced apart from the first portions of the cutting tools and are farther from the first mounting frame than the first portions, and at least some of the first and second radial deflection distances are altered in unison with each other.

Technical aspects of the methods and apparatuses described above include the ability to control the cutting gaps of the cutting tools. Such aspects preferably include the ability to accurately control the cutting gaps by controlling deflections of different portions of the cutting tools. For example, different portions of an individual cutting tool can be deflected different radial deflection distances to compensate for potentially very small variations in the geometries and dimensions of the cutting head resulting from manufacturing tolerances of the cutting tool and its components, with the result that a more uniform and constant cutting gap associated with the cutting tool may be achieved along the entire length of the cutting blade associated with each cutting gap.

Other aspects and advantages of the disclosure will be further appreciated from the following detailed description.

DETAILED DESCRIPTION

Figure 1:
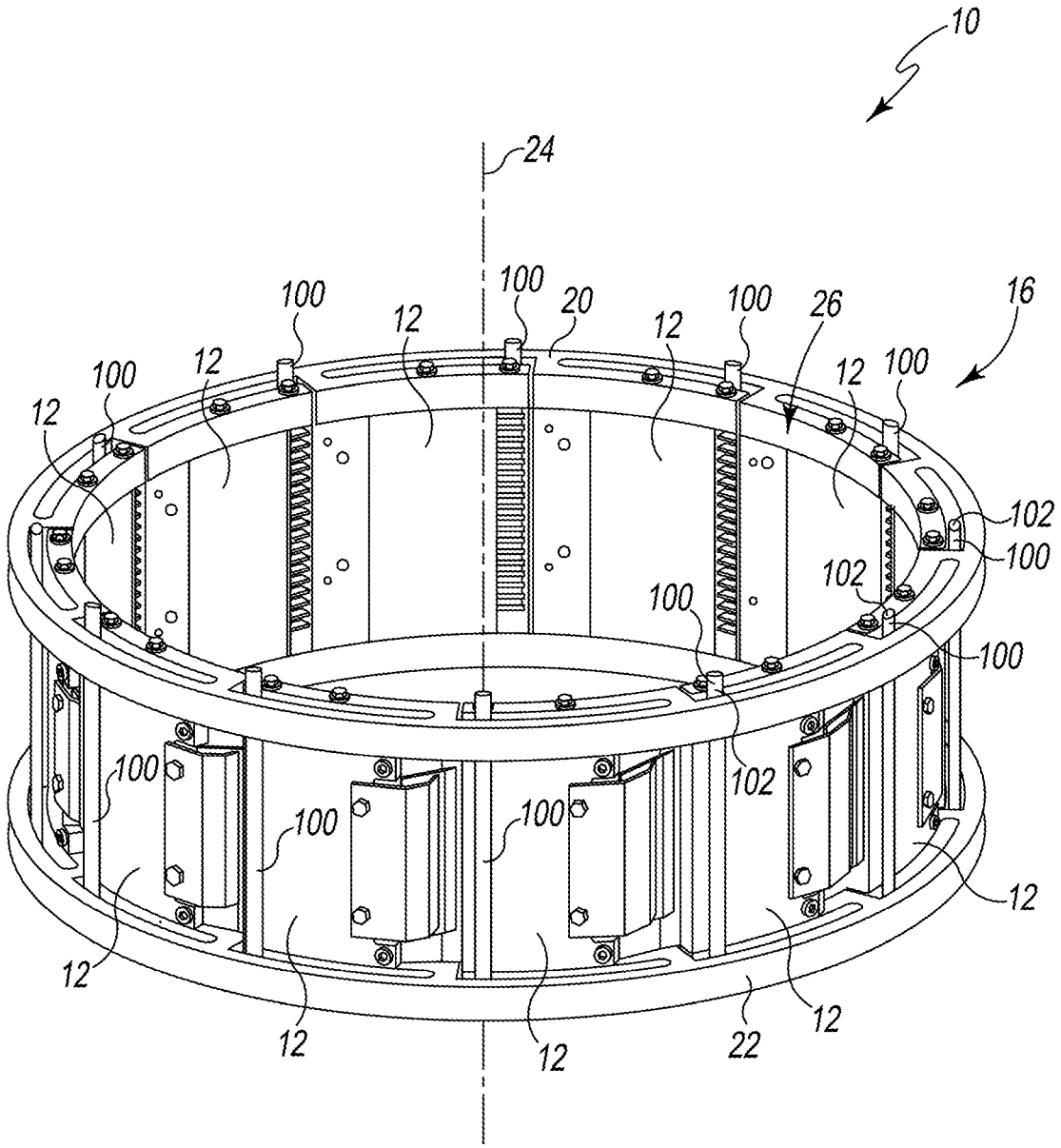
FIG. 1 is a perspective view of a cutting head of an apparatus for cutting food products in accordance with a nonlimiting embodiment of the disclosure.

The drawings schematically represent specific exemplary embodiments of cutting heads suitable for use in apparatuses adapted for cutting food products. While concepts of the present disclosure are susceptible to various modifications and alternative forms, the embodiments have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the disclosure as defined by the appended claims.

To facilitate the description provided below of the embodiments represented in the drawings, relative terms, including but not limited to, "vertical," "horizontal," "lateral," "front," "rear," "side," "forward," "rearward," "upper," "lower," "above," "below," "right," "left," etc., may be used in reference to a typical installation of the embodiments when used as represented in the drawings. Furthermore, on the basis of an axial arrangement of the cutting heads, relative terms including but not limited to "axial," "circumferential," "radial," etc., and related forms thereof may also be used below to describe the nonlimiting embodiments represented in the drawings. Furthermore, as used herein, "trailing" (and related forms thereof) refers to a position on a cutting head that follows or succeeds another in the direction of rotation of an impeller (e.g., FIGS. 7 and 8) coaxially assembled with the cutting head, whereas "leading" (and related forms thereof) refers to a position on a cutting head that is ahead of or precedes another in the direction opposite the impeller's rotation. All such relative terms are intended to indicate the construction and relative orientations of components and features of the cutting heads, and therefore are intended to indicate the construction, installation and use of the disclosure and therefore help to define the scope of the disclosure.

Referring now to FIG. 1, a cutting head 10 for an apparatus for cutting food products includes a plurality of cutting tools 12 configured to cut food products into slices or strips. The cutting head 10 is configured to be mounted coaxially with an impeller 14 (FIGS. 7 and 8) that rotates relative to the cutting head 10 to direct food products into engagement with the cutting tools 12, as described in greater detail below. In the embodiment of FIG. 1, the cutting head 10 includes an adjustment mechanism 16, which may be operated to change the positions of the cutting tools 12 and thereby change the thicknesses of the food slices produced by the cutting head 10.

The cutting head 10 of FIG. 1 includes an upper mounting frame 20 and a lower mounting frame 22 that is spaced apart from the upper mounting frame 20 along a longitudinal or central axis 24 of the cutting head 10. The cutting tools 12 are arranged around the central axis 24 and positioned between the frames 20 and 22. The frames 20 and 22 and the cutting tools 12 cooperate to define a central cavity 26 in which the impeller 14 is positioned for coaxial rotation within the cutting head 10.

Figure 2:
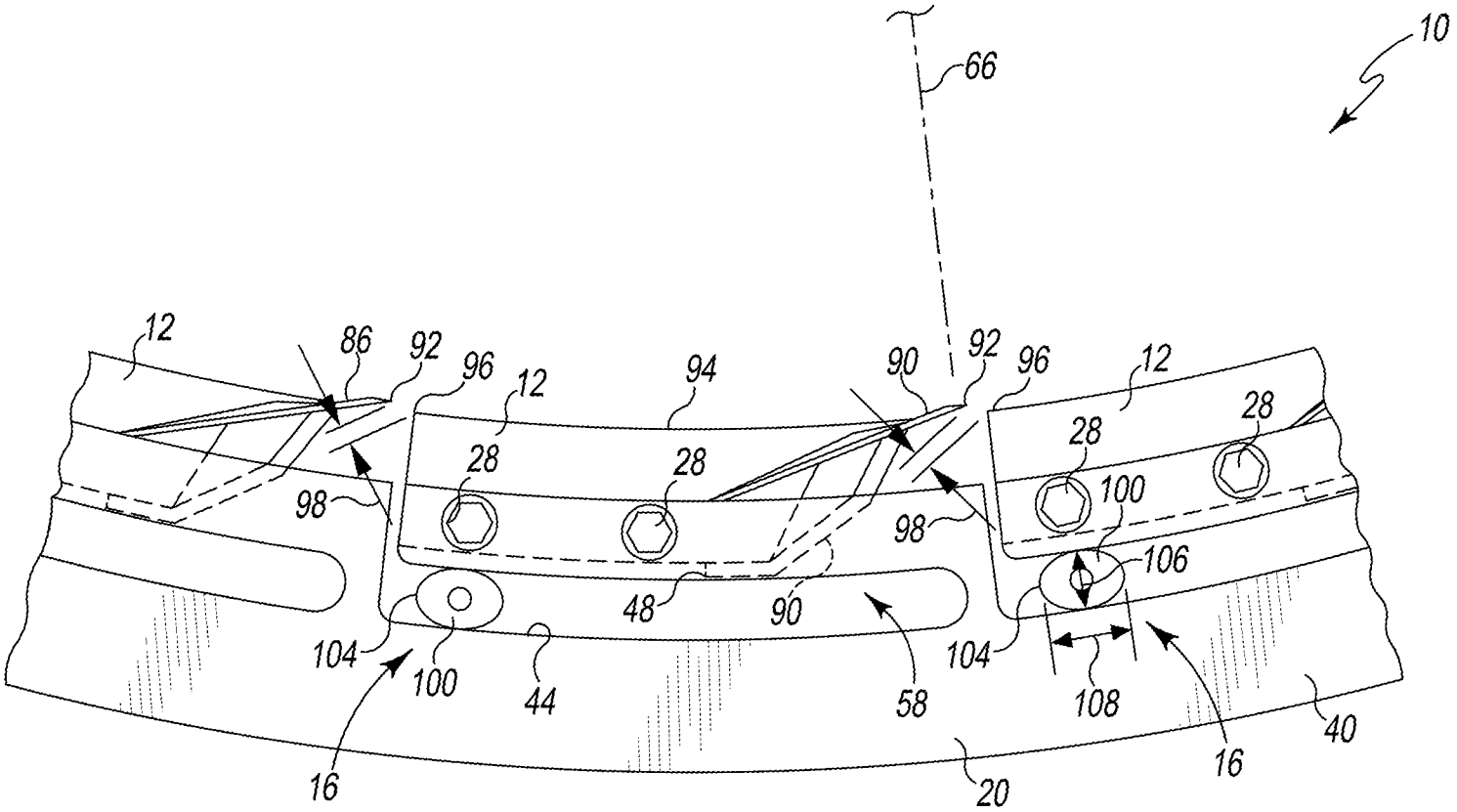
FIG. 2 is a top plan view of a section of the cutting head of FIG. 1.

As shown in FIG. 2, each cutting tool 12 is secured to the frames 20 and 22 via a number of fasteners 28. Each fastener 28 is illustratively a bolt 28, which extends through each cutting tool 12 and the frames 20 and 22. It should be appreciated that in other embodiments the cutting tools may be secured to the frames 20 and 22 via other means such as, for example, welding or the frictional retainer.

Each of the frames 20 and 22 is a single integral component formed from a metallic material such as, for example, stainless steel. It should be appreciated that in other embodiments one or both of the frames 20 and 22 may be formed as separate components that are later assembled to form each frame 20 and 22. Additionally, the components of each frame 20 and 22 may be formed from different materials, including other metallic materials or polymers. In the embodiment of FIG. 1, the configuration of the lower mounting frame 22 is identical to the configuration of the upper mounting frame 20 such that only the configuration of the upper mounting frame 20 is described in greater detail.

Figure 3:
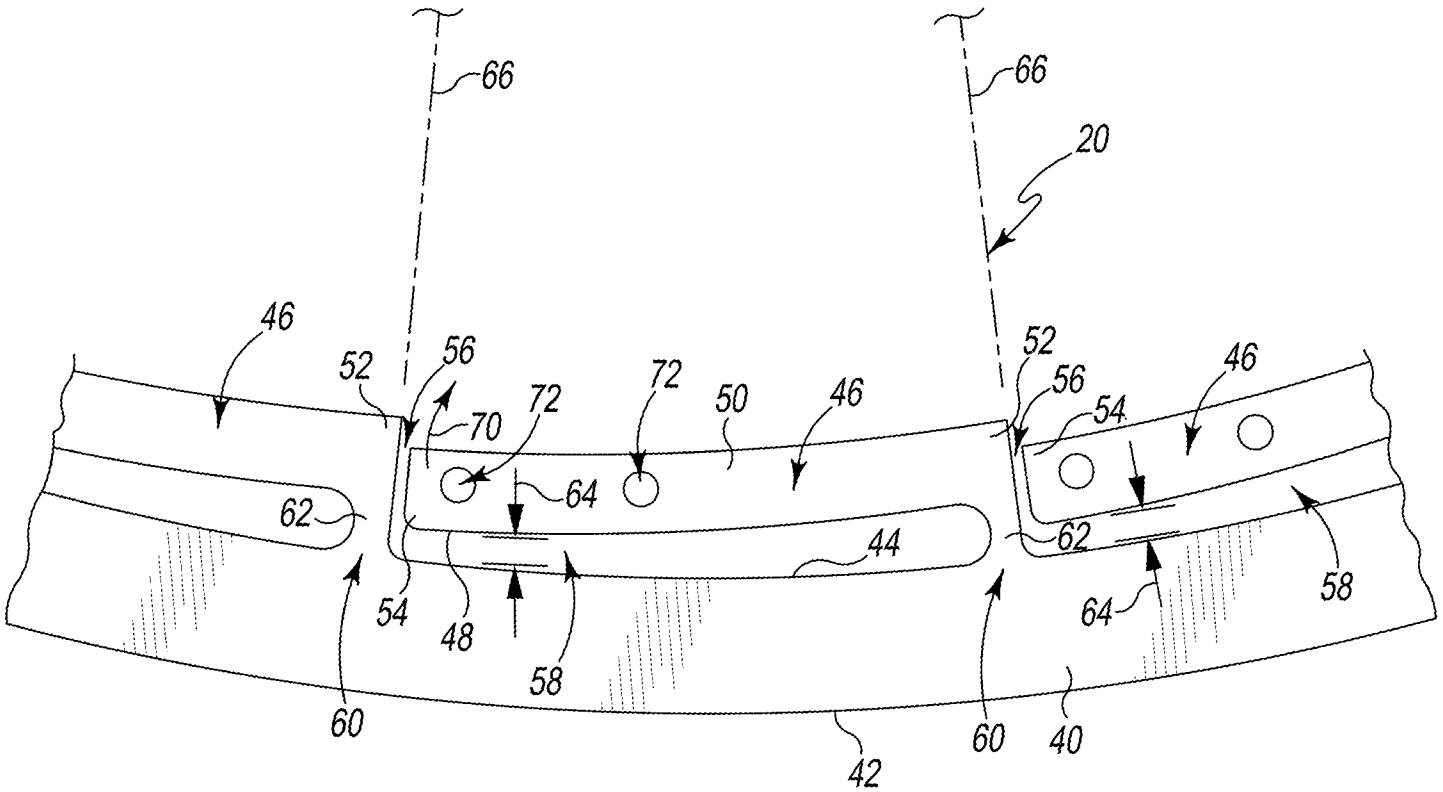
FIG. 3 is a view similar to FIG. 2 showing a section of a mounting ring of the cutting head of FIG. 1.

Referring now to FIG. 3, the mounting frame 20 includes an annular outer ring 40 that extends around the central axis 24. The outer ring 40 has an outer wall 42 that defines the outer circumference of the frame 20 and an inner wall 44 that faces the central axis 24. The frame 20 also includes a plurality of mounting arms 46 that are arranged around the central axis 24 and positioned radially inward (i.e., closer to the central axis 24) of the inner wall 44. Each mounting arm 46 is configured to be secured to one of the ends of a cutting tool 12, as described in greater detail below.

Each mounting arm 46 includes an elongated body 50 that extends from a forward end 52 to a rear tip 54. The rear tip 54 of each mounting arm 46 is spaced apart from the forward end 52 of the next adjacent mounting arm 46 such that a slot 56 is defined between each end 52 and each tip 54. Each elongated body 50 includes an outer wall 48 that is spaced apart from the inner wall 44 of the outer ring 40 such that a channel 58 is defined between each body 50 and the inner wall 44. Each slot 56 opens into one of the channel 58, as shown in FIG. 3.

As represented in FIG. 3, the frame 20 also includes an integral hinge 60 that connects the forward end 52 of each arm 46 to the inner wall 44 of the outer ring 40. The integral hinges 60 are positioned at each end of each channel 58 such that an L-shaped opening is defined between the inner wall 44 and each pair of mounting arms 46. Each integral hinge 60 is configured to permit the rear tip 54 of its corresponding mounting arm 46 (and hence cutting tool 12) to rotate or pivot relative to the outer ring 40. It should be appreciated that in other embodiments one or more of the mounting arms 46 may be connected to the outer ring 40 via other types of joints using pins, keys, or other fasteners to couple each arm 46 to the outer ring 40.

Each integral hinge 60 includes a beam 62 that extends from the inner wall 44 of the outer ring 40 to the forward end 52 of each arm 46. In the embodiment of FIGS. 1 to 3, the beam 62 is the joint that rotatably couples each cutting tool 12 to outer ring 40. The beam 62 is sized and shaped to deflect resiliently when the rear tip 54 of its corresponding mounting arm 46 is pivoted or rotated in the direction indicated by arrow 70 in FIG. 3. Each mounting arm 46 and each beam 62 are shown in their resting positions in FIG. 3, and a distance 64 is defined between each rear tip 54 and the inner wall 44 of the outer ring 40. Each beam 62 is located on an imaginary radial line 66 extending from the central axis 24.

When each beam 62 is deflected from its resting position, it exerts a force in the direction opposite the arrow 70 to resist further deflection. In that way, the beam 62 is a biasing element that biases each mounting arm 46 toward the position shown in FIG. 3. As used herein, the term "biasing element" refers to resilient or elastic structures or devices that exert an opposing force when compressed, stretched, or otherwise deflected from their resting positions. In addition to the beam 62, other biasing elements include mechanical springs and elastomeric plugs or bodies. Although the frames 20 and 22 include only two biasing elements (i.e., upper and lower beams 62) for each mounting arm 46, it should be appreciated that in other embodiments the cutting head 10 may include additional or fewer biasing elements for each mounting arm 46 (and hence each cutting tool 12). It should also be appreciated that in other embodiments additional combinations of biasing elements may be included.

As described above, each mounting arm 46 is configured to be secured to one of the ends of a cutting tool 12. As represented in FIG. 2, each mounting arm 46 includes a number of bores 72 that correspond to, and are sized to receive, the number of bolts 28 that secure each cutting tool 12 to the upper and lower frames 20 and 22. Each bore 72 extends through the elongated body 50 of each mounting arm 46 parallel to the central axis 24 of the cutting head 10. It should be appreciated that in other embodiments each mounting arm may have additional or fewer bores depending on the number and nature of the fasteners used to secure the cutting heads to the mounting arms.

Figure 4:
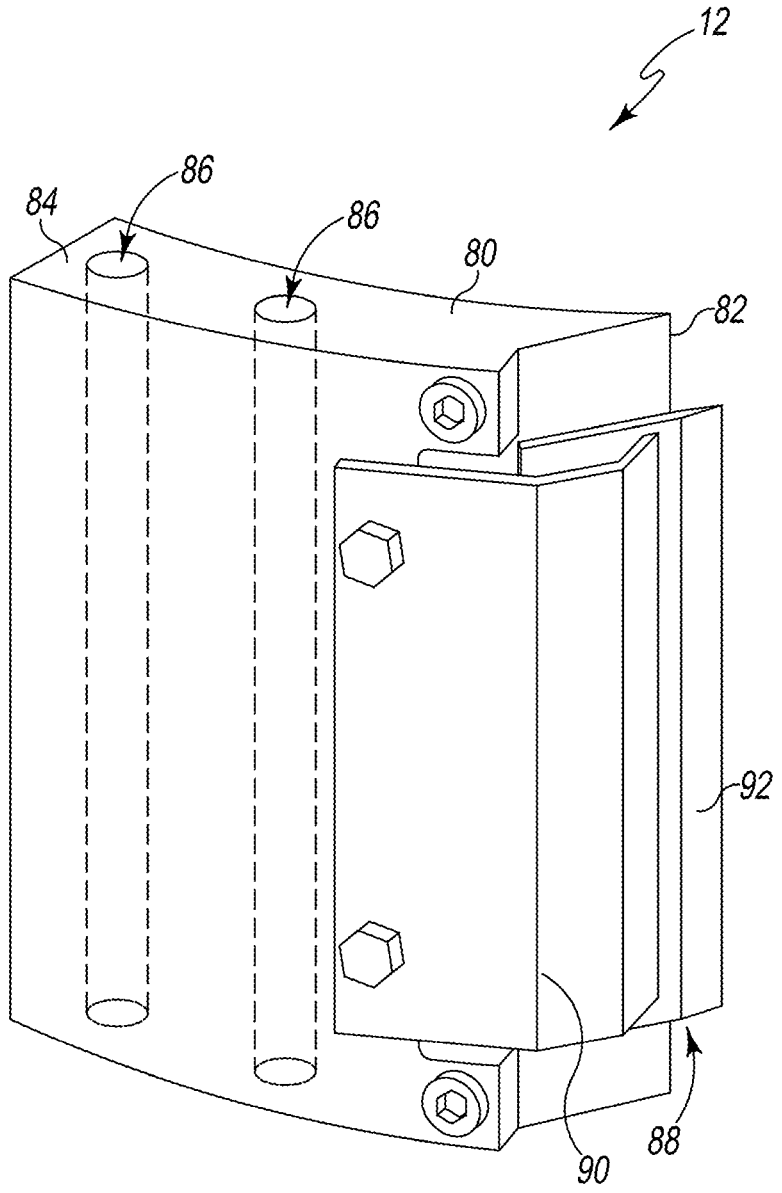
FIG. 4 is a perspective view of a cutting tool of the cutting head of FIG. 1.

Referring now to FIG. 4, one of the cutting tools 12 of FIGS. 1 to 3 is shown. The configuration of each cutting tool 12 of the cutting head 10 may be identical, such that only a single cutting tool 12 is described in greater detail. Each cutting tool 12 includes a base 80 that extends from a longitudinal end 82 of the tool 12 to an opposite longitudinal end 84. The base 80 also has a number of bores 86 that are sized to receive the bolts 28 and extend through the base 80 parallel to the central axis 24 of the cutting head 10. Each bore 86 is positioned to align with a corresponding bore 72 of the upper and lower frames 20 and 22.

Each cutting tool 12 also includes a knife or cutting blade 88 that is secured to the base 80 at the longitudinal end 82. The cutting blade 88 has a body 90 that extends outwardly from the base 80 to a cutting edge 92 that is configured to cut food products that are advanced into engagement with the cutting blade 88 by the impeller 14.

Returning to FIG. 2, the cutting edge 92 of the cutting blade 88 is positioned adjacent to an inner wall 94 of the base 80, on the imaginary radial line 66 extending through the beam 62. As represented in FIG. 2, the inner wall 94 is a concave curved wall that extends from the longitudinal end 82 to the other longitudinal end 84. The inner wall 94 also includes a trailing edge 96 that is positioned at the end 84. As described in greater detail below, the trailing edge 96 of one cutting tool 12 cooperates with the cutting edge 92 of the next adjacent cutting tool 12 to form a cutting gap 98 whose width (as measured in the direction of rotation of an impeller coaxially assembled with the cutting head 10) defines the thickness of the slices produced between those cutting tools 12. The adjustment mechanism 16 is operable to move the cutting tools 12 to adjust the widths of the cutting gaps 98.

For each cutting tool 12, the adjustment mechanism 16 includes a moveable stop in the form of an elongated shaft 100, which is positioned in the channels 58 of the upper and lower mounting frames 20 and 22. As shown in FIG. 1, each shaft 100 has an end 102 positioned above the upper mounting frame 20 and extends downwardly from the end 102 parallel to the central axis 24 through the upper and lower mounting frames 20 and 22. As shown in FIGS. 1 to 2, each shaft 100 has an oblong outer surface 104 that engages the inner wall 44 of the outer ring 40 and the outer walls 48 of its corresponding mounting arms 46 of the upper and lower mounting frames 20 and 22.

The oblong outer surface 104 of each shaft 100 is oval-shaped and has a minor diameter 106 and a major diameter 108. The minor diameter 106 is sized to be greater than the distance 64 defined between each mounting arm 46 and the outer ring 40 when the mounting arm 46 is at its resting position. In that way, the shafts 100 are configured to preload the beams 62 of the integral hinges 60 by moving the mounting arms 46 (and hence their cutting tools) away from their resting positions to the cutting position shown in FIG. 2 and FIG. 5. In that cutting position, the oblong outer surface 104 engages each mounting arm 46 and the outer ring 40 along its minor diameter 106 and the corresponding beam 62 exerts a biasing force in the direction indicated by arrow 110 in FIGS. 5 to 6. Each shaft 100 is configured to be separately rotated about its axis to the cutting position shown in FIG. 6, with the oblong outer surface 104 of each shaft 100 acting as a cam to move the mounting arm 46 relative to the outer ring 40. In the cutting position of FIG. 6, the oblong outer surface 104 engages each mounting arm 46 and the outer ring 40 along its major diameter 108 and the corresponding beam 62 exerts a stronger biasing force in the direction indicated by arrow 110.

Figure 5:
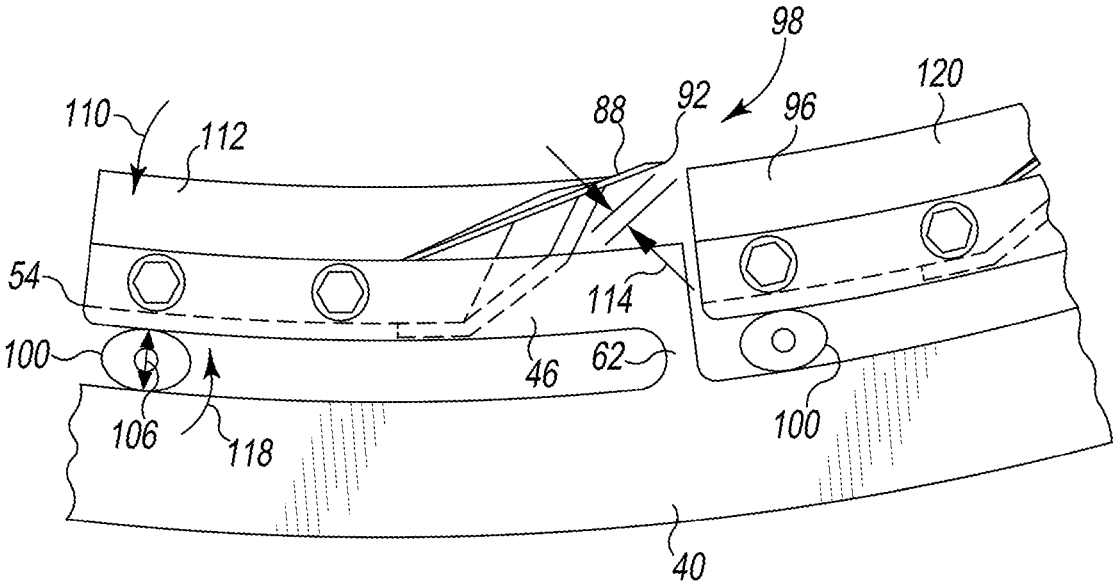
FIG. 5 is a top plan view of a section of the cutting head of FIG. 1 showing a cutting tool placed at one cutting position.
Figure 6:
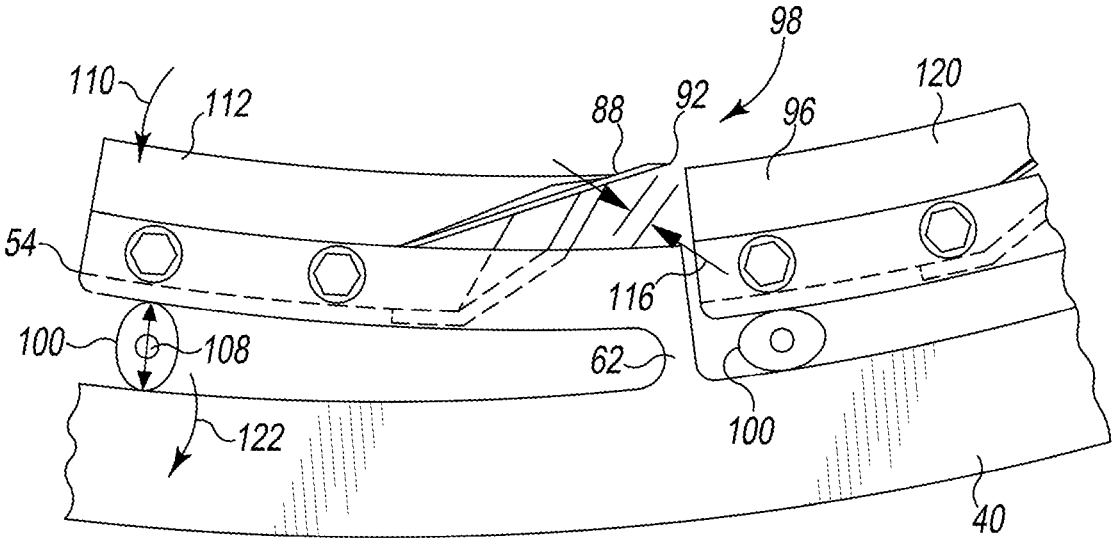
FIG. 6 is a view similar to FIG. 5 showing the cutting tool placed at another cutting position.

As shown in FIGS. 5 to 6, each shaft 100 is configured to be independently operated to separately adjust each cutting gap 98. For example, when one of the cutting tools (cutting tool 112 in FIGS. 5 to 6) is in the cutting position shown in FIG. 5, the cutting gap 98 has a width 114, which affects the thickness of the resulting food product slice. When the cutting tool 112 is placed in the cutting position shown in FIG. 6, the cutting gap 98 has a smaller width 116, which will result in a food product slice of smaller thickness during operation. To move the cutting tool 112 between the position shown in FIG. 5 and the position shown in FIG. 6, a user may grasp the shaft 100 that engages the cutting tool 112 and rotate the shaft 100 in the direction indicated by arrow 118. As the shaft 100 is rotated and the oblong outer surface 104 transitions from the minor diameter 106 to the major diameter 108, the rear tip 54 of the mounting arm 46 is moved toward the central axis 24 of the cutting head 10 and away from the outer ring 40. The cutting edge 92 of the cutting blade 88 of the cutting tool 112 is advanced toward the trailing edge 96 of the adjacent cutting tool (cutting tool 112 in FIGS. 5 to 6) to narrow the width of the cutting gap 98.

It should be appreciated that the shaft 100 may be rotated to any angular position between the two positions shown in FIGS. 5 to 6 such that the cutting tool 112 may be placed at any number of cutting positions to permit the creation of food product slices having a variety of different cutting thicknesses. At each cutting position, the beam 62 connecting the cutting tool 112 to the outer ring 40 exerts a biasing force in the direction indicated by arrow 110 to bias the mounting arm 46 into engagement with the elongated shaft 100. When the shaft 100 is rotated in the direction indicated by arrow 122 in FIG. 6, the biasing force exerted by the beam 62 urges the rear tip 54 toward the inner wall 44 of the outer ring 40, thereby causing the cutting edge 92 of the cutting blade 88 to move away from the trailing edge 96 of the cutting tool 112 and widening the cutting gap 98.

The components of the cutting tools 112 are formed separately and assembled as shown in FIGS. 1 to 6. Each cutting blade 88 may be formed from a metallic material, such as, for example, stainless steel. Each elongated shaft 100 is formed from a metallic material such as, for example, stainless steel. In other embodiments, the shafts may be formed from, for example, a polymeric material.

Figure 7:
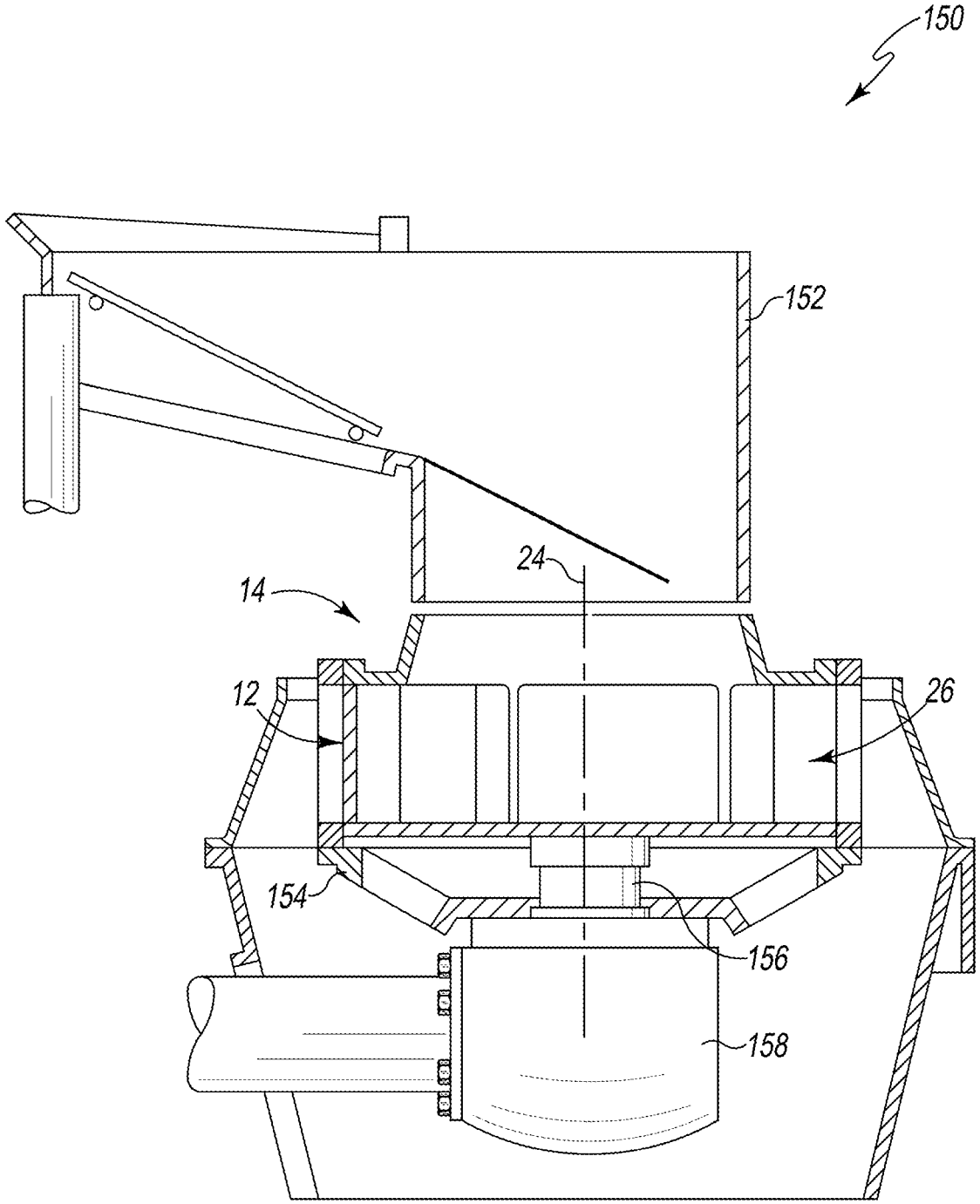
FIG. 7 is a cross-sectional view of an apparatus for cutting food products including the cutting head of FIG. 1.

Referring now to FIG. 7, the cutting head 10 is included in an apparatus for cutting food products into slices or strips. The apparatus is illustratively a centrifugal slicing machine 150 including an impeller 14 that is positioned in the cavity 26 of the cutting head 10. The machine 150 also includes a feed hopper 152 that is positioned above the cavity 26 of the cutting head 10. The feed hopper 152 is sized to receive food products and direct them downward into the cavity 26 and into contact with the impeller 14.

The cutting head 10 is secured to a frame 154 of the machine 150 and is stationary. The impeller 14 is configured to rotate relative to the cutting head 10 about the axis 24. As shown in FIG. 7, the impeller 14 is mounted on a drive shaft 156 that is connected to a gearbox 158. The gearbox is connected to a motor (not shown). The motor, gearbox, and drive shaft are operable to rotate the impeller 14. It should be appreciated that in other embodiments the machine 150 may include additional components to rotate the impeller 14.

Figure 8:
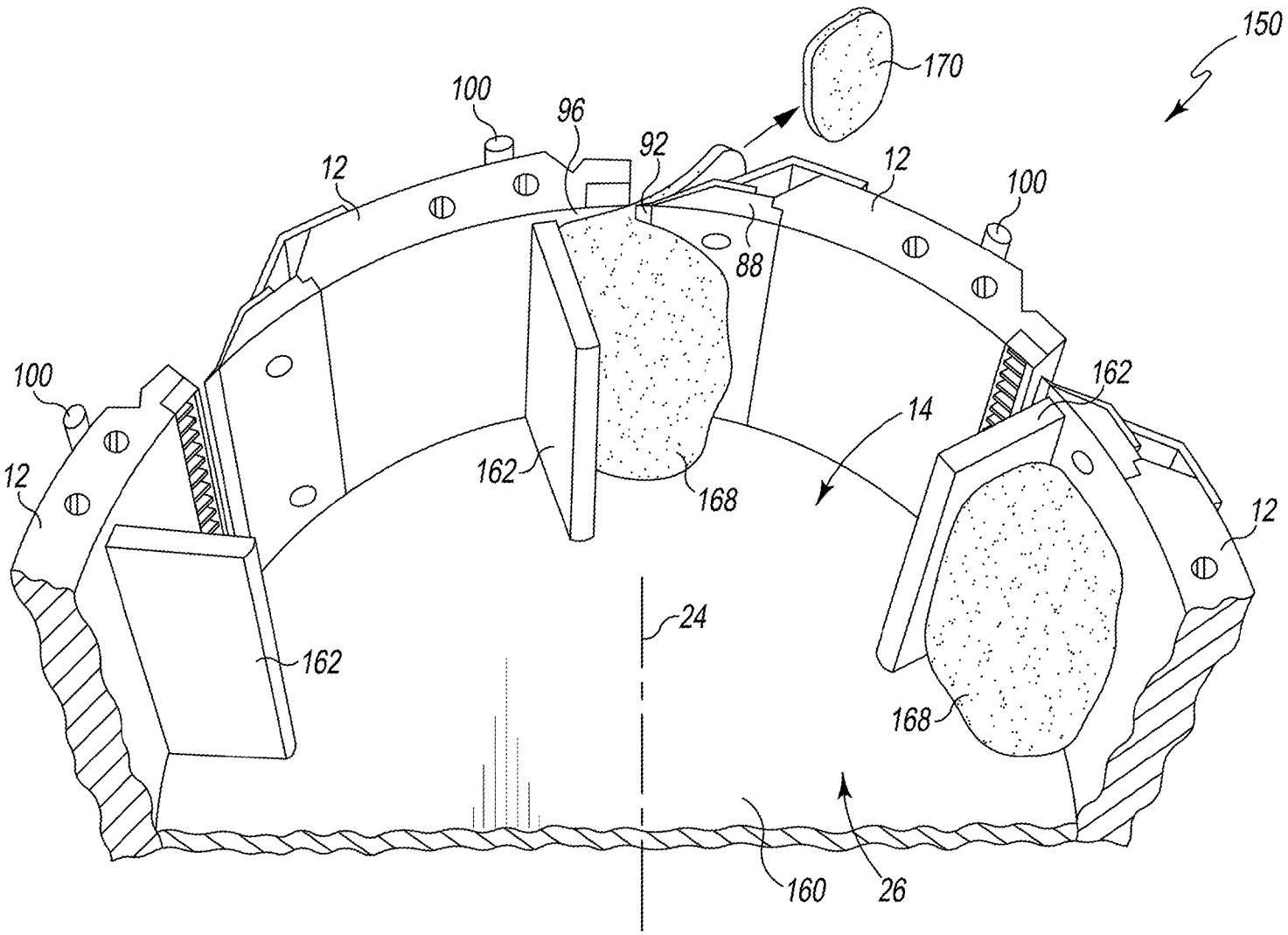
FIG. 8 is a partial cross-sectional perspective view of the cutting head and the apparatus of FIG. 7.

As shown in FIG. 8, the impeller 14 includes a plate 160 and a plurality of paddles 162 that extend upwardly from the plate 160. Each of the paddles 162 is arranged around the central axis 24 and extends radially outward toward the cutting head 10. Each paddle 162 is positioned to direct food products into engagement with the cutting tools 12 of the cutting head 10, which are arranged along the outer periphery of the plate 160.

In use, food products 168 are advanced through the feed hopper 152 into the cavity 26 while the impeller 14 is rotating. The rotation of the impeller 14 pushes the food products 168 into contact with the paddles 162 and centrifugal force causes the food products 168 to advance radially outward into contact with the cutting tools 12. As shown in FIG. 8, the cutting blades 88 of the cutting tools 12 trim each food product 168 between the cutting edge 92 of one cutting tool 12 and the trailing edge 96 of the adjacent cutting tool 12 and the removed portion (e.g., the slice 170) of the food product 168 advance through the cutting gap 98 to be collected in the slicing machine 150 for further processing. As described above, a user may operate the adjustment mechanism 16 to adjust the width of each cutting gap 98 by rotating each shaft 100 to vary the position of the cutting blade 88. The position of the shafts 100 permits the user to operate the adjustment mechanism 16 while operating the machine 150.

Figure 9:
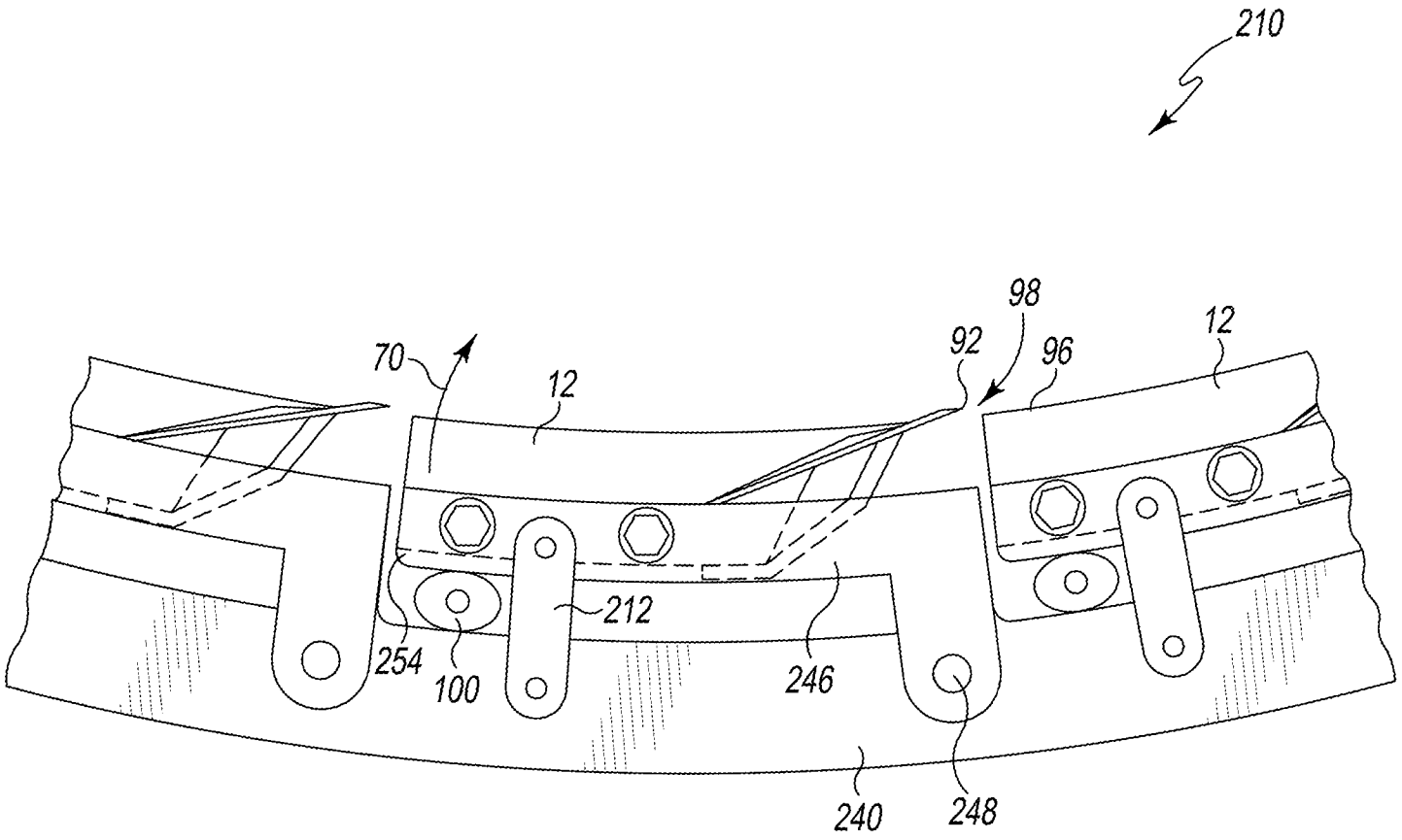
FIG. 9 is a top plan view of a section of another nonlimiting embodiment of a cutting head.

As described above, the cutting head may include different biasing elements configured to preload each cutting tool 12 in for example, as shown in FIG. 9, a cutting head 210 includes a spring, which is illustratively an elastic strap 212 that extends between an outer ring 240 and a mounting arm 246. The mounting arm 246 is pivotally coupled to the outer ring 240 via a pivot pin 248 that extends through the mounting arm 246 and the outer ring 240. The elastic strap 212, like the beam 62 described above in regard to the cutting head 10, is sized and shaped to stretch resiliently when the rear tip 254 of the mounting arm 246 is pivoted or rotated about the pin 248 in the direction indicated by arrow 70 in FIG. 9. In that way, the strap 212 exerts a biasing force in the opposite direction to bias the mounting arm 246 into engagement with the elongated shaft 100.

Figure 10:
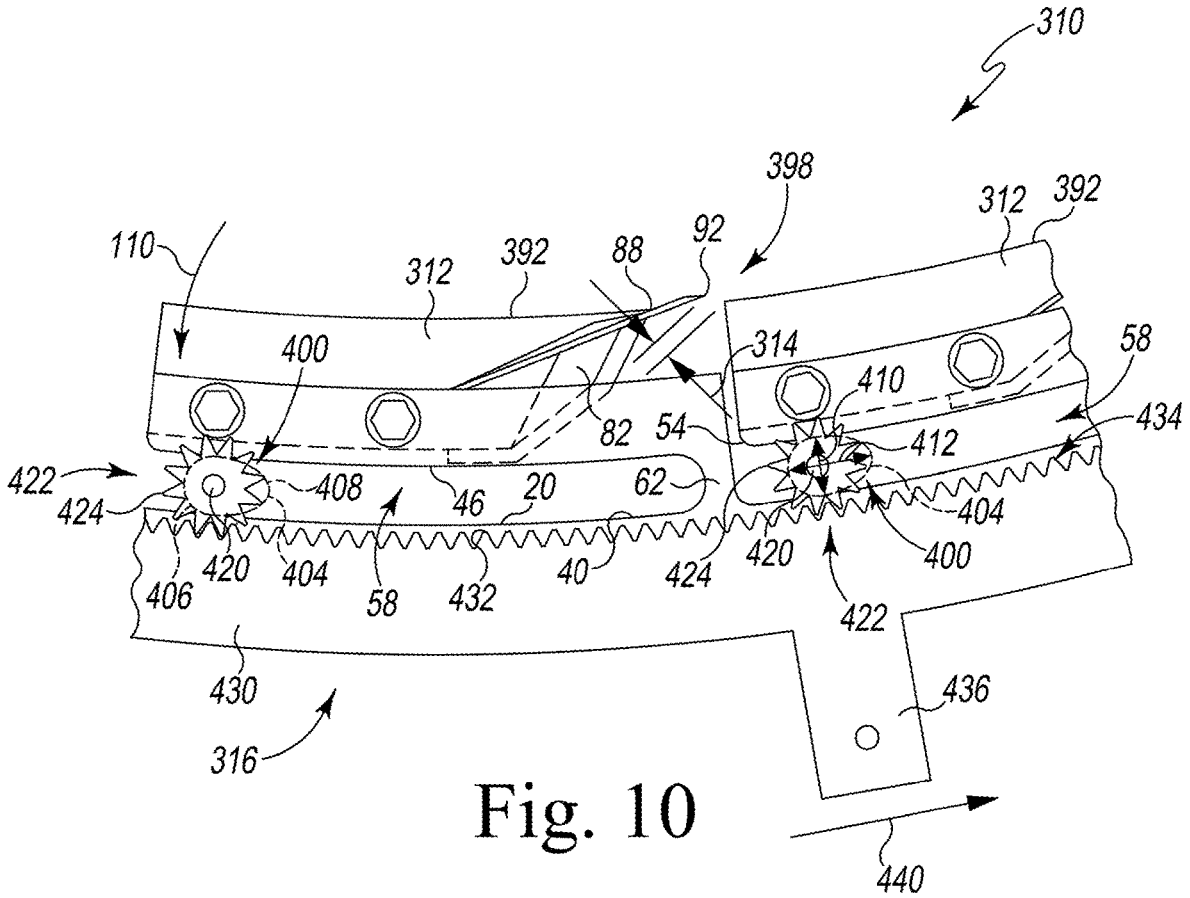
FIG. 10 is a top plan view of a section of another nonlimiting embodiment of a cutting head showing a cutting tool placed at one cutting position.
Figure 11:
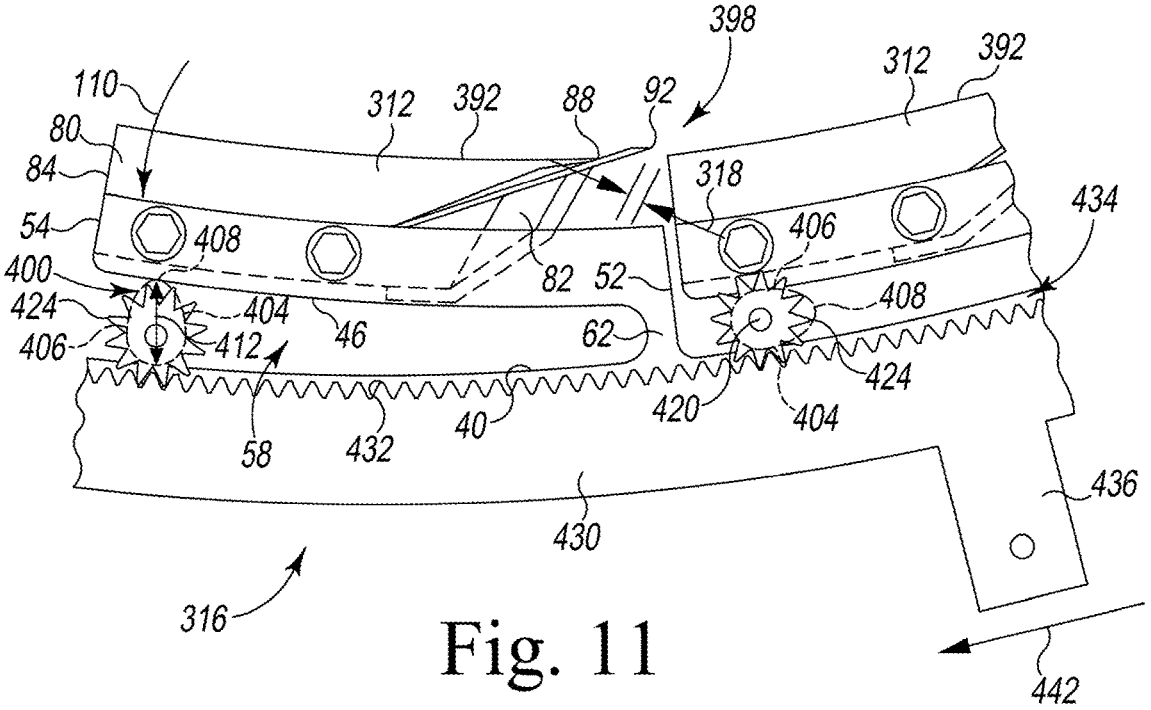
FIG. 11 is a view similar to FIG. 10 showing the cutting tool placed at another cutting position.

Referring now to FIGS. 10 and 11, a portion of another embodiment of a cutting head (hereinafter the cutting head 310) is shown. Some of the structures of the cutting head 310 are similar to the structures described above in regard to the cutting head 10. Those structures are identified with the same reference numbers in FIGS. 10 and 11. The cutting head 310 includes a plurality of cutting tools 312 and an adjustment mechanism 316, which may be operated to change the positions of all of the cutting tools 312 to change the thicknesses of the food slices produced by the cutting head 310.

Similar to the cutting head 10, the cutting head 310 includes an upper mounting frame 20 and a lower mounting frame (not shown) that is spaced apart from the upper mounting frame 20 along a central axis 24. In FIGS. 10 and 11, the configuration of the lower mounting frame may be identical to the configuration of the upper mounting frame 20.

Each cutting tool 312 includes a base 80 that extends from a longitudinal end 82 of the tool 312 to an opposite longitudinal end 84. Each cutting tool 312 also includes a knife or cutting blade 88 that is secured to the base 80 at the longitudinal end 82. The cutting blade 88 has a cutting edge 92 that is configured to cut food products that are advanced into engagement with the cutting blade 88 by the impeller 14.

The cutting edge 92 of the cutting blade 88 is positioned adjacent to an inner wall of the base 80 In one embodiment, the inner wall 94 includes a concave curved surface 392 that extends from the longitudinal end 82 to the edge 84. As shown in FIGS. 10 and 11, the concave curved surface 392 of one cutting tool 312 cooperates with the cutting edge 92 of the adjacent cutting tool 312 to form a cutting gap 398 that defines the thickness of the slices produced between those cutting tools 312.

In the embodiment of FIGS. 10 and 11, the adjustment mechanism 316 is operable to move the cutting tools 312 to adjust the width of the cutting gap 398. The adjustment mechanism 316 includes a plurality of moveable stops in the form of the elongated shafts 400, which are positioned in the channels 58 of the upper and lower mounting frames 20 and 22. As shown in FIGS. 1 to 2, each shaft 400 has an oblong outer surface 404 that engages the inner wall 44 of the outer ring 40 and the outer walls 48 of its corresponding mounting arms 46 of the upper and lower mounting frame 20. Each elongated shaft is formed from a metallic material such as, for example, stainless steel. Each shaft 400 has a longitudinal axis that extends parallel to the central axis 24 and is configured to rotate about its longitudinal axis.

The oblong outer surface 404 of each shaft 400 includes a semicircular section 406 and a semi-elliptical section 408 that cooperate to define a minor diameter 410 and a major diameter 412. The minor diameter 106 is sized to be greater than the distance 64 defined between each mounting arm 46 and the outer ring 40 when the mounting arm 46 is at its resting position. In that way, the shafts 400 are configured to preload the beams 62 of the integral hinges 60 by moving the mounting arms 46 (and hence their cutting tools) away from their resting positions to the cutting position shown in FIG. 10. In that cutting position, the oblong outer surface 404 engages each mounting arm 46 and the outer ring 40 along its minor diameter 410 (i.e., the semicircular section 406) and the corresponding beam 62 exerts a biasing force in the direction indicated by arrow 110 in FIGS. 10 and 11. As described in greater detail below, the adjustment mechanism 316 is operable to rotate the shafts 400 about their respective axes to the cutting positions shown in FIG. 11, with the oblong outer surfaces 404 acting as cams to move the mounting arms 46 relative to the outer ring 40. In those cutting positions, the oblong outer surface 404 engages each mounting arm 46 and the outer ring 40 along its major diameter 412 and the corresponding beam 62 exerts a stronger biasing force in the direction indicated by arrow 110.

As shown in FIGS. 10 and 11, each shaft 400 is configured to be independently operated to separately adjust each cutting gap 398. For example, when one of the cutting tools (cutting tool 312 in FIGS. 10 and 11) is in the cutting position shown in FIG. 10, the cutting gap 398 has a thickness 314, which defines the thickness of the resulting food product slice. Further, when one of the cutting tools (cutting tool 312 in FIGS. 10-11) is in the cutting position shown in FIG. 11, the cutting gap 398 has a thickness 318, which defines a thickness of the resulting food product slice that differs from the thickness of the resulting food product slice created when the cutting tool 312 is in the cutting position shown in FIG. 10.

As shown in FIGS. 10 and 11, each shaft 400 has a pin 420 that extends outwardly from the upper mounting frame 20. The adjustment mechanism 316 includes gears 422, each of which is coupled to one of the pins 420. Each gear 422 is secured to its corresponding pin 420 such that the gears 422 and the shafts 400 rotate together. Each gear 422 includes a plurality of teeth 424 that are formed around the gear's outer circumference. Each gear 422 is illustratively formed from a metallic material such as, for example, stainless steel.

The adjustment mechanism 316 also includes an outer ring 430 that extends around the central axis 24 of the cutting head 310. The outer ring 430 is also formed from a metallic material such as, for example, stainless steel in this embodiment. The outer ring 430 is moveably coupled to the upper mounting frame 20 and configured to rotate about a rotation axis that is coincident with the central axis 24. The outer ring 430 has an inner wall 432 and a plurality of teeth 434 that are defined in the inner wall 432. As shown in FIGS. 10 and 11, the teeth 434 of the ring 430 are interdigitated with the teeth 424 of the gears 422. When the outer ring 430 is rotated relative to the upper mounting frame 20, the engagement between the teeth 424 causes the gears 422 (and hence the shafts 400) to rotate between cutting positions. In the embodiment of FIGS. 10 and 11, the adjustment mechanism 316 also includes a handle 436 that extends from the outer ring 430. The handle 436 may be used to rotate outer ring 430 in the directions indicated by arrows 440, 442 and thereby operate the adjustment mechanism 316 to move all of the cutting tools 312 between cutting positions.

It may be appreciated that the cutting head may include other adjustment mechanisms operable to change the position of the cutting tools. For example, the outer rings may include one or more sloped inner surfaces that engage the trailing ends of each mounting arm to cause the cutting tools to rotate or pivot. In other embodiments, the cutting head may include a lever arm that is connected at one end of each cam and at the opposite end to a corresponding mounting arm. A pivot point on the lever arm may be located such that larger movements of the cam and/or the outer ring may deliver smaller movements to mounting arm(s), to provide a fine adjustment mechanism and to create higher resolution change in the gap size. One embodiment of such a design is shown in FIGS. 12 and 13.

FIGS. 12 to 15 depict a cutting head 510 according to yet another nonlimiting embodiment of the disclosure, in which the aforementioned positive adjustment is enabled across the entire axial length of each cutting tool 512 of the cutting head 510. Some of the structures of the cutting head 510 are similar to the structures described above in regard to the cutting heads 10, 210, and 310 of FIGS. 1 to 11. In view of similarities between the embodiment of FIGS. 12 to 15 and the previously described embodiments, the following discussion of FIGS. 12 to 15 will focus primarily on aspects thereof that differ from the previous embodiments in some notable or significant manner. Other aspects of the embodiment of FIGS. 12 to 15 not discussed in any detail can be, in terms of structure, function, materials, etc., essentially as was described for the previous embodiments.

Figure 12:
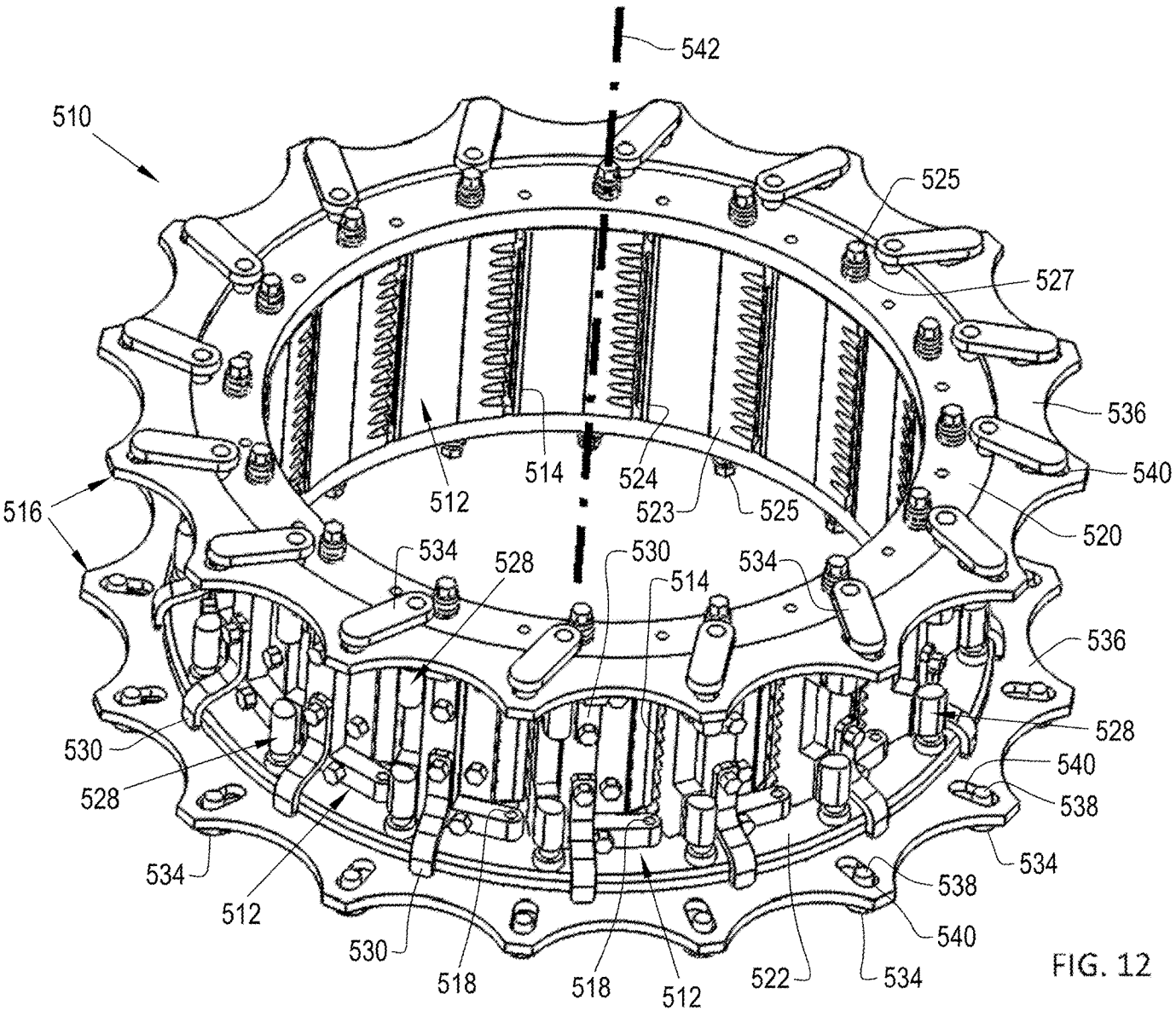
FIG. 12 is a perspective view of a cutting head for cutting food products in accordance with another nonlimiting embodiment of the disclosure.
Figure 13:
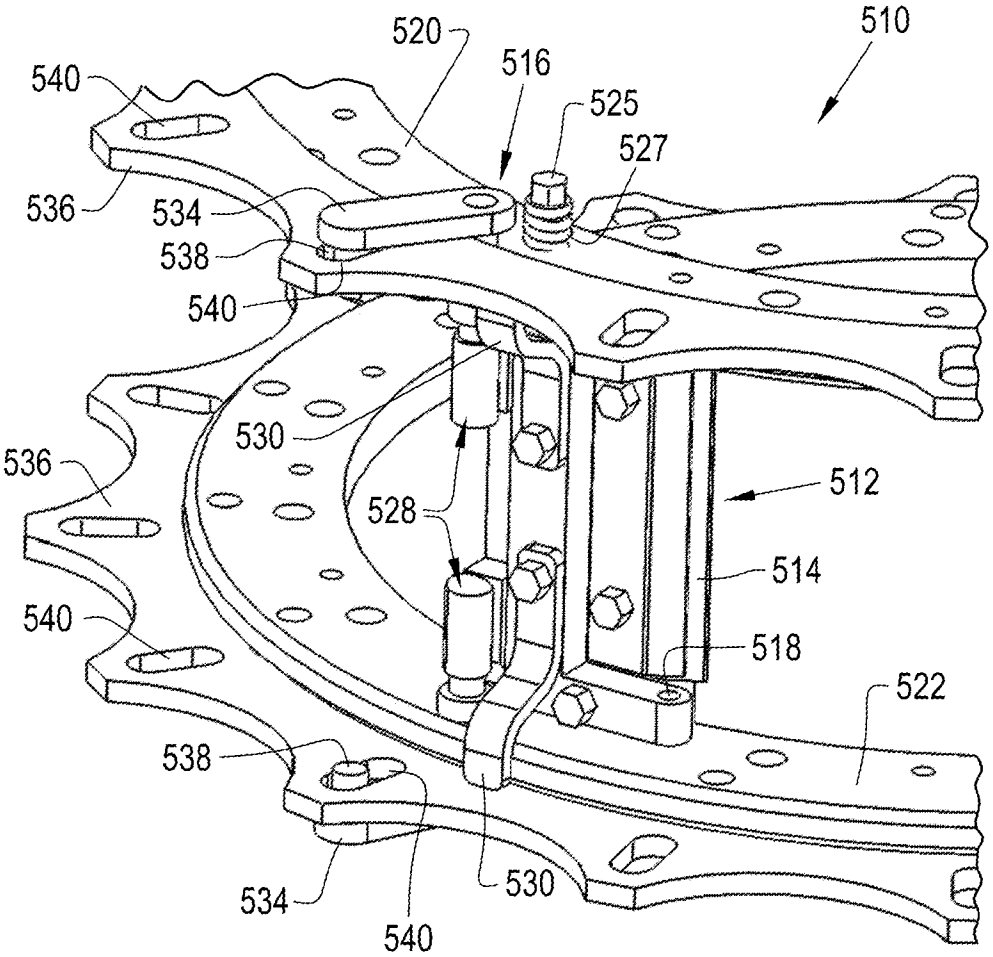
FIG. 13 is a perspective view showing a fragment of the cutting head of FIG. 12, including a pair of mounting frames, a cutting tool pivotally mounted to the mounting frames, and a pair of control rings for pivoting the cutting tool relative to the mounting frames.

The cutting head 510 is represented in FIG. 12 as including an adjustment mechanism 516 operable to change the positions of all of the cutting tools 512 to change the thicknesses of food slices produced by the cutting head 510. The cutting head 510 include a pair of upper and lower mounting frames 520 and 522 that surround a central axis 542 of the cutting head 510 and are axially spaced apart along the central axis 542. The cutting tools 512 are arranged around the central axis 542 of the cutting head 510 and are disposed between and pivotably coupled to the mounting frames 520 and 522, such as with axially aligned pins 518, so that each cutting tool 512 has a pivot axis roughly parallel to the central axis 542 of the head 510 and about which the cutting tools 512 are able to pivot relative to the frames 520 and 522.

Figure 14:
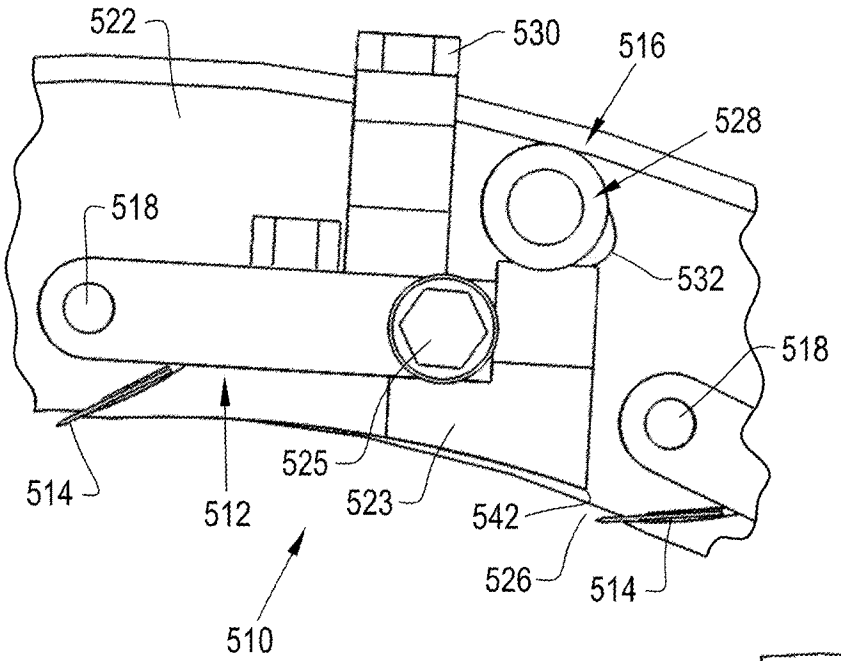
FIGS. 14 and 15 are top plan views that schematically depict different relative positions of an adjacent pair of cutting tools of the cutting head of FIG. 12 as a result of pivoting of the cutting tools.
Figure 15:
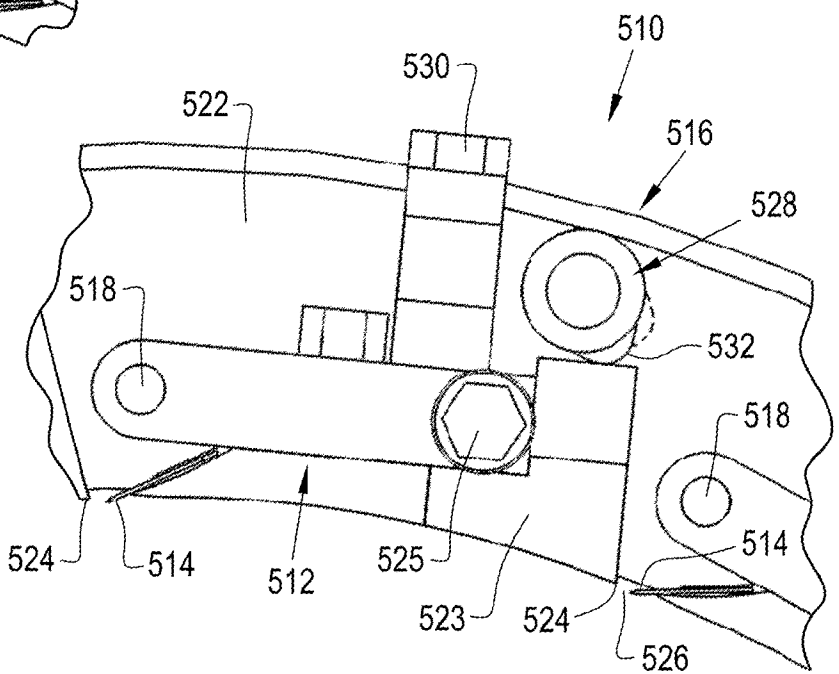
Figure 16:
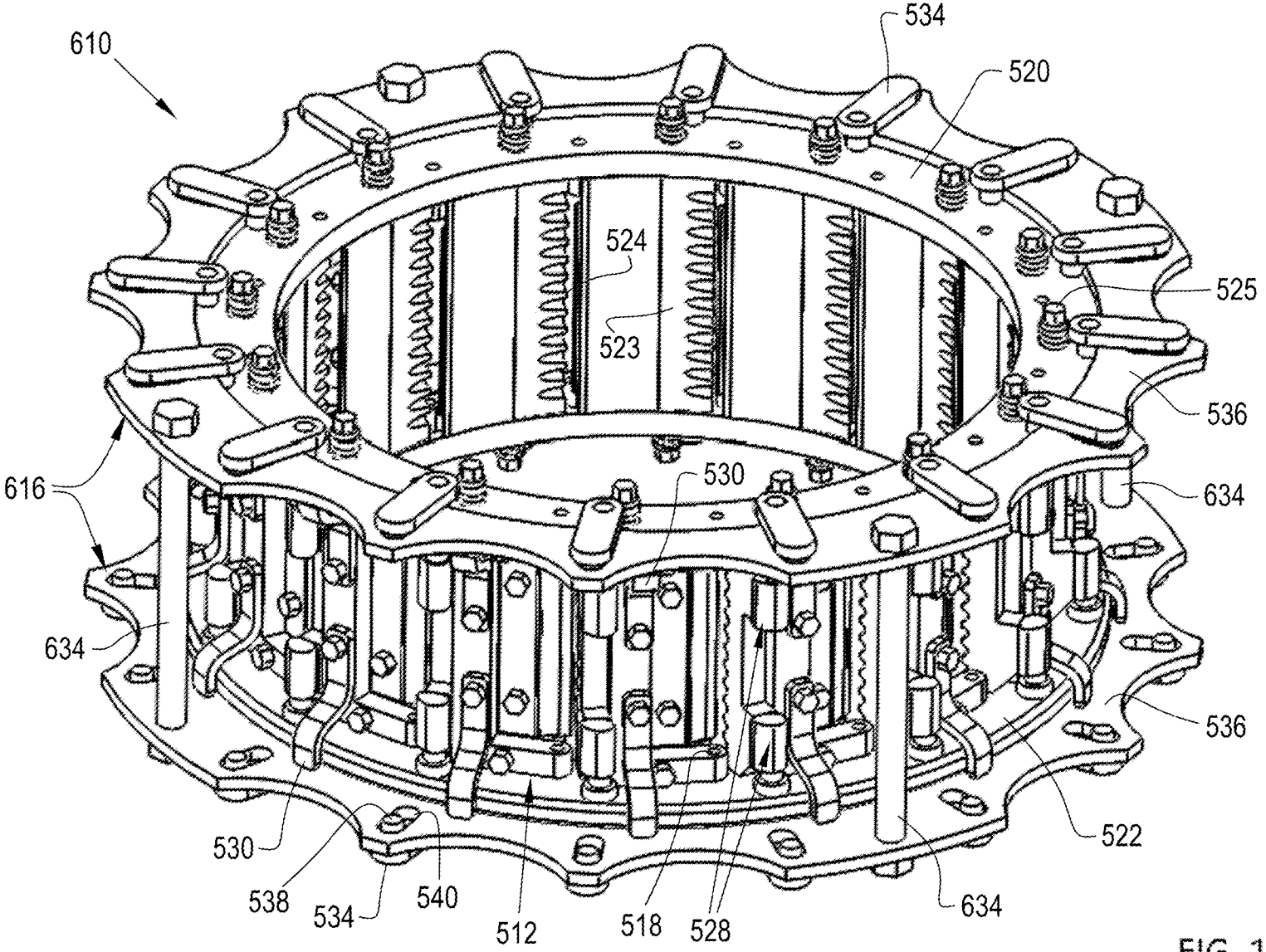
FIGS. 16 and 17 are perspective views of cutting heads for cutting food products in accordance with additional nonlimiting embodiments of the disclosure.

The cutting tools 512 may be described as arranged in sequential pairs around the circumference of the cutting head 510, whereby each cutting tool 512 serves as a leading cutting tool 512 to an adjacent trailing cutting tool 512 of the sequential pair. Each cutting tool 512 has a removable cutting blade 514 positioned at a leading side of the cutting tool 512 and a trailing edge 524 positioned at a trailing side of the cutting tool 512 opposite the cutting blade 514. FIGS. 12, 14, and 15 represent the trailing edge 524 of each cutting tool 512 as defined by a removable component, referred to herein as a gate 523, that defines a replaceable interior transition surface and may be secured with fasteners (not shown) to the tool 512. As best seen in FIGS. 14 and 15, the trailing edge 524 of each cutting tool 512 cooperates with the cutting blade 514 of the trailing cutting tool 512 to define a cutting gap (or gate opening) 526 therebetween. As further evident from FIGS. 14 and 15, pivoting of the cutting tools 512 results in their cutting blades 514 and their trailing edges 524 being pivoted either toward or away from the central axis 542 of the cutting head 510, with the result that the trailing edges 524 are shown in FIGS. 14 and 15 as located at different radial distances from the central axis 542, and the radial distance in FIG. 15 is less than the radial distance in FIG. 14. FIGS. 14 and 15 depict a sequential pair of cutting tools 512 as having been rotated to different positions, with the result that the cutting gap 526 has a first gap width in the first position depicted in FIG. 14, and the cutting gap 526 has a second gap width in the second position depicted in FIG. 15, wherein the second gap width of FIG. 15 is less than the first gap width of FIG. 14. It is foreseeable that more or less rotation of the cutting tools 512 in either direction could result greater or lesser gap widths for the cutting gap 526 than what is depicted in FIGS. 14 and 15. In any event, adjusting the gap width of the cutting gap 526 alters the thicknesses of slices produced with the cutting head 510, with smaller cutting gaps 526 corresponding to thinner product slices. As such, the configuration represented in FIG. 14 will produce thicker slices than the configuration represented in FIG. 15.

To create a rigid structure with the cutting tools 512, the mounting frames 520 or 522 are represented as being secured to each other with a bolt assembly 525 that passes through each cutting tool 512 (FIGS. 14 and 15) with sufficient clearance therebetween to enable the tools 512 to move relative to the bolt assemblies 525 and allow for the desired pivoting and adjustment capability as described above. The bolt assemblies 525 are represented as equipped with springs 527 (or other suitable biasing means) that apply a load capable of holding the frames 520 and 522 tightly against the cutting tools 512, while still allowing the tools 512 to move between the frames 520 and 522 when the adjustment mechanism 516 is operated.

The adjustment mechanism 516 includes means for deflecting each cutting tool 512 about its pivot axis, which as previously noted is defined by pivot pins 518. As such, the pivot axes of the cutting tools 512 coincide with their respective pins 518. The deflecting means are represented in FIGS. 12 to 15 as comprising multiple deflecting units 528 that engage surfaces of the cutting tools 512 near the trailing edges 524 thereof (for example, surfaces of the gates 523 as represented in FIGS. 14 and 15). FIGS. 12 to 15 further represent the pivot pins 518 as located adjacent and roughly on the same radial of the cutting head 510 as the cutting edges of their respective cutting blades 514. As such, the cutting edge of the blade 514 of each cutting unit 512 is much closer to the pivot axis of the unit 512 than the deflecting unit(s) 528 associated with the cutting unit 512, and therefore the radial movement induced by a deflecting unit 528 at the trailing edge 524 of a cutting tool 512 generates a much smaller radial movement of the cutting tool 512 at the cutting edge of its blade 514. In this manner, the deflecting units 528 are capable of providing very fine adjustments of the cutting gap 526 defined by and between the cutting blade 514 of a tool 512 and the trailing edge 524 of the tool 512 that precedes it. Though advantageous under certain circumstances, a fine adjustment capability is not required in all embodiments, and as such the locations of the pivot pins 518 and deflecting units 528 on the cutting tools 512 and relative to each other could differ from what is shown in the drawings.

The deflecting units 528 associated with each cutting unit 512 are represented in FIGS. 12 to 15 as arranged in pairs of separate deflecting units 528 that share a common axis, i.e., are coaxial. A first (upper) set of the deflecting units 528 is coupled to the upper mounting frame 520 and each upper deflecting unit 528 has camming means in the form of a cam 532 having a cam lobe that engages a first (upper) portion of its corresponding cutting tool 512 in proximity to the upper mounting frame 520 to radially deflect the upper portion a radial deflection distance relative to the central axis 542 of the cutting head 510. Similarly, a second (lower) set of the deflecting units 528 is coupled to the lower mounting frame 522 and each has a cam 532 having a cam lobe that engages a second (lower) portion of the cutting tool 512 in proximity to the lower mounting frame 522 to radially deflect the lower portion a radial deflection distance relative to the central axis 542 of the cutting head 510. Because the cams 532 associated with a cutting tool 512 are spaced apart in the axial direction of the cutting head 510, the contact between each upper deflecting unit 528 and the upper portion of the corresponding tool 512 is discontinuous with the contact between the corresponding lower deflecting unit 528 and the lower portion of the same tool 512.

In the nonlimiting embodiment of FIGS. 14 and 15, each deflecting unit 528 is a camming unit mounted for rotation relative to its respective frame 520 or 522, and rotation of the deflecting units 528 about their axes causes their respective cams 532 to deflect the cutting tools 512 away from their first positions represented in FIG. 14 and toward their second positions represented in FIG. 15. While cams 532 with cam lobes are depicted in the drawings, other camming means are also within the scope of the disclosure, including eccentric cams, face cams, linear or wedge-shaped cams, levers, and other devices capable of translating one form of motion into a force capable of radially deflecting the cutting tools 512 relative to the central axis 542 of the cutting head 510.

Though shown as engaging only upper and lower (two) portions of the cutting tools 512, it is foreseeable that the deflecting units 528 could comprise any number of cams 532 positioned to engage any surface and any number of surfaces of the cutting tools 512. The deflecting units 528 are represented as being machined such that their cams 532 are integral portions of the deflecting units 528. Each deflecting unit 528 may be rotationally and axially adjustable with respect to the mounting frames 520 and 522 so that the rotational and axial positions of their cams 532 can be individually configured to cam against a higher or lower portion of a cutting tool 512. It is also foreseeable that the cams 532 may be separately fabricated and assembled on a shaft of their respective deflecting units 528, enabling the rotational and axial positions of each cam 532 to be adjusted on its deflecting unit 528, which in turn enables each cam 532 to be individually configured to cam against a higher or lower portion of a cutting tool 512.

As represented in FIGS. 12 to 15, the cutting tools 512 are biased radially outward away from the central axis 542 of the cutting head 510 to maintain engagement with their deflecting units 528, such that the cams 532 of the deflecting units 528 effectively serve as adjustable stops for the cutting tools 512. In the particular embodiment shown, biasing is accomplished with cantilever springs 530, each having one end connected to a cutting tool 512 and another end engaging the perimeter of one of the mounting frames 520 or 522. However, other means for maintaining engagement of the cutting tools 512 with the cams 532 of the deflecting units 528 are foreseeable and therefore within the scope of the disclosure, including biasing means of types described in reference to previous embodiments.

The adjustment mechanism 516 of FIGS. 12 to 15 further includes means for operating the deflecting units 528 to alter the radial deflection distances of the portions of the cutting tools 512 engaged by their cams 532. In the nonlimiting embodiment depicted, the operating means comprise two (upper and lower) sets of levers 534, each individually coupled to one of the deflecting units 528 such that pivoting of the levers 534 causes their respective deflecting units 528 to rotate. The operating means are represented in FIGS. 12 and 13 as further including upper and lower control rings 536. Similar to the outer rings 40, 240, and 430 of previously-described embodiments, each control ring 536 is axially aligned with the mounting frames 520 and 522 and adapted to rotate about the central axis 542 of the cutting head 510. The levers 534 are represented as having nubs or pins 538 that engage slots 540 in the rings 536, such that rotation of a ring 536 causes its corresponding levers 534 to pivot, which in turn causes the corresponding deflecting units 528 to pivot and deflect their respective cutting tools 512. The pins 538 are operable to additionally capture the control rings 536 such that the rings 536 can be secured by the levers 534 to their respective mounting frame 520 or 522. The outer perimeters of the control rings 536 are represented as being scalloped to reduce the additional weight contributed by the rings 536 to the cutting head 510.

In the embodiment of FIGS. 12 to 15, the deflecting units 528 are not coupled together and the control rings 536 are not coupled together, such that the upper and lower control rings 536 are independently coupled to the upper and lower sets of levers 534, respectively, to independently rotate the upper and lower sets of deflecting units 528. As such, though each control ring 536 simultaneously operates (rotates) its corresponding set of levers 534 and the deflecting units 528 they operate (rotate) in unison with each other, such that the deflections induced by the upper deflecting units 528 in the upper portions of the cutting tools 512 can be the very same and the deflections induced by the lower deflecting units 528 in the lower portions of the cutting tools 512 can be the very same, the control rings 536 operate their respective deflecting units 528 independently of each other, such that the deflection induced by the cams 532 of the upper deflecting units 528 in the upper portions of the cutting tools 512 is not required to be the same, and may be intentionally different from, the deflection induced by the cams 532 of the lower deflecting units 528 in the lower portions of the cutting tools 512. Alternatively, the control rings 536 can be independently rotated to operate their respective deflecting units 528 to intentionally vary the cutting gap 526 associated with each sequential pair of cutting tools 512 along the lengths of the cutting blades 514 associated with the cutting gaps 526. In each case, the precision with which the cutting gaps 526 can be adjusted is determined by the contours of the cams 532 and slots 540 and the engagement of the lever pins 538 with the slots 540.

In contrast to the embodiment of FIGS. 12 to 15, FIG. 16 depicts a cutting head 610 in which the adjustment mechanism 616 further comprises means for coupling the deflecting units 528 together. In the nonlimiting embodiment of FIG. 16, the control rings 536 are rigidly coupled together with rods 634 that are spaced at or near the perimeters of the rings 536. As such, the control rings 536 simultaneously rotate in unison with each other and the levers 534 and deflecting units 528 they operate rotate in unison with each other, such that the deflection induced by the upper deflecting units 528 in the upper portions of the cutting tools 512 may be the very same as the deflection induced by the corresponding lower deflecting units 528 in the lower portions of the cutting tools 512. Even so, the deflecting units 528 may be mounted in the mounting frames 20 and 22 to be independently adjustable (rotatable) relative to each other so that the deflection induced by the upper deflecting units 528 in the upper portions of the cutting tools 512 is intentionally different from the deflection induced by the corresponding lower deflecting units 528 in the lower portions of the cutting tools 512. For example, the cams 532 of the upper or lower deflecting units 528 could be in the rotational position depicted in FIG. 14, while the cams of the other set of deflecting units 528 could be in the rotational position depicted in FIG. 15. Otherwise, the cutting head 610 of FIG. 16 may be identical to the cutting head 510 of FIGS. 12 to 15.

Figure 17:
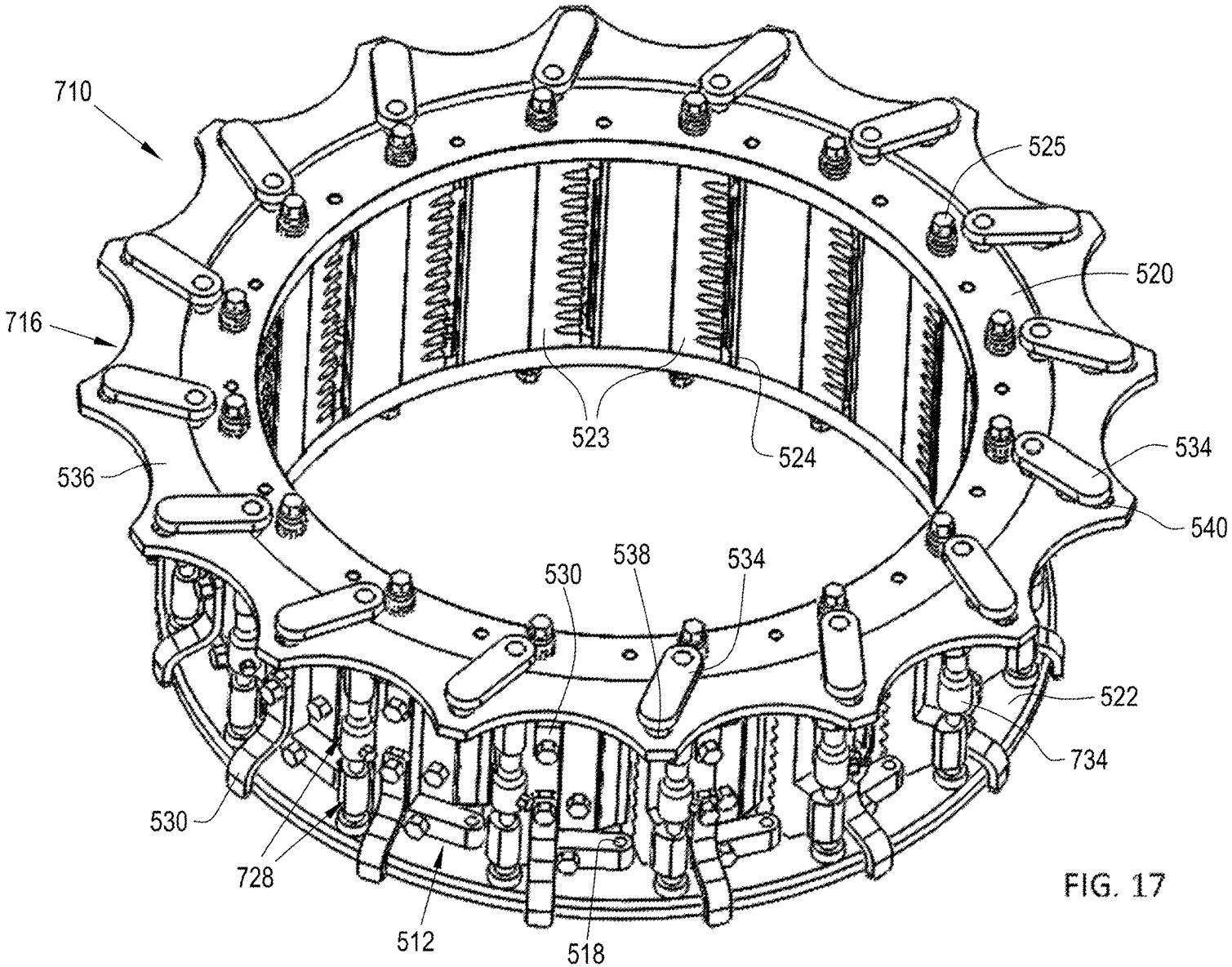
Figure 19:
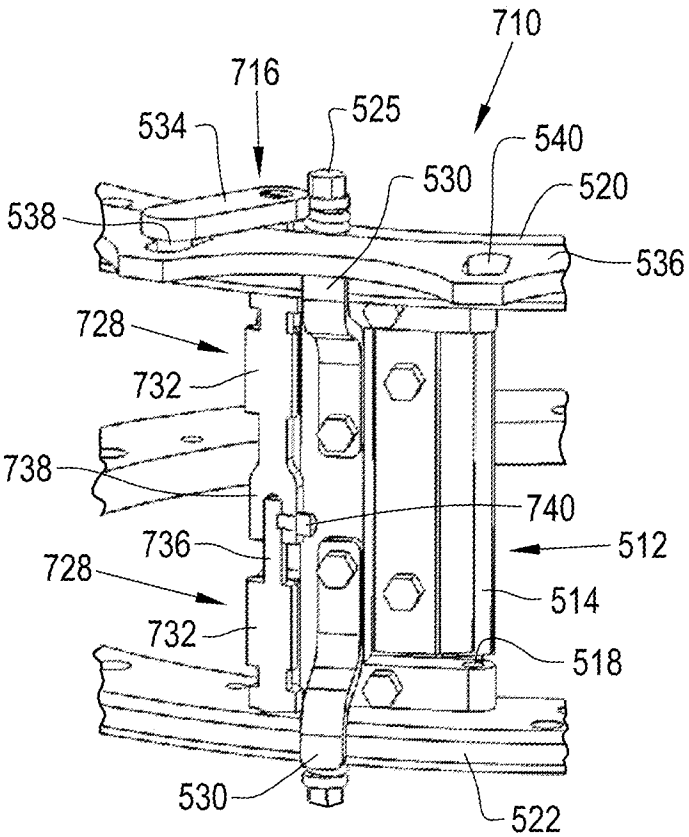
FIG. 19 is a perspective view showing deflecting units of the cutting tool of FIG. 18 in cross-section.
Figure 18:
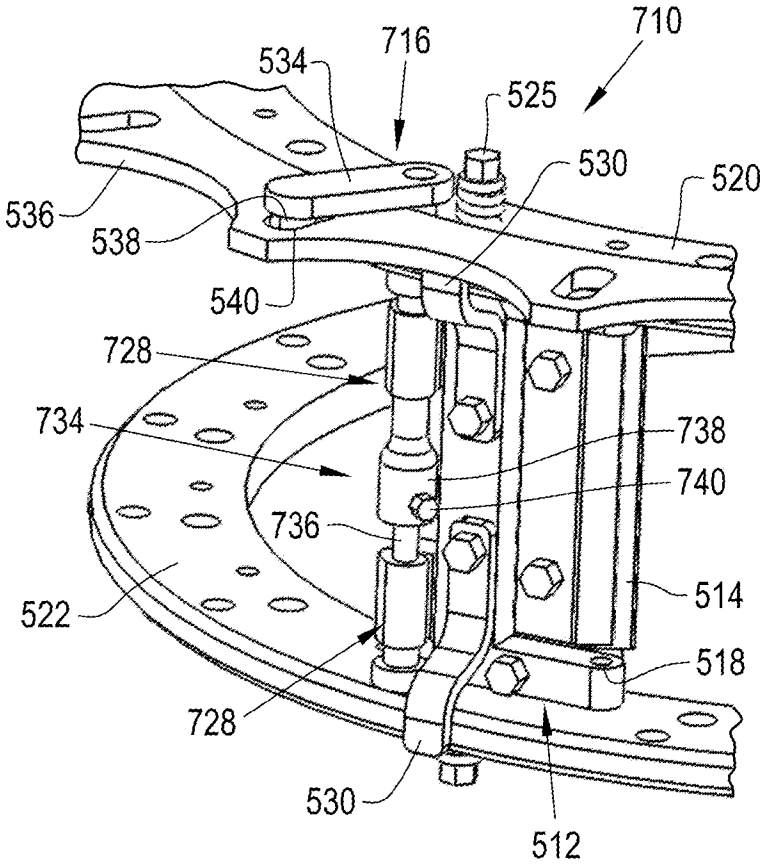
FIG. 18 is a perspective view showing a fragment of the cutting head of FIG. 17, including a pair of mounting frames, a cutting tool pivotally mounted to the mounting frames, and a single control ring for pivoting the cutting tool relative to the mounting frames.

FIGS. 17 to 19 depict a cutting head 710 that embodies further modifications to the cutting heads 510 and 610 of FIGS. 12 to 16 as a result of its adjustment mechanism 716 omitting one set of levers 534 and the corresponding control ring 536 of the cutting heads 510 and 610, while still retaining the capability of positively adjusting the widths of the cutting gap across the entire axial length of each cutting tool 512 of the cutting head 710. This feature is advantageous if there is a desire to minimize the weight of a cutting head while retaining the advantages of previously described embodiments.

The adjustment mechanism 716 is depicted as equipped with upper and lower deflecting units 728 that are directly coupled together with a coupling 734. In the particular embodiment shown, each coupling 734 comprises a shaft 736 extending from the lower deflecting units 728 and received in a collar 738 extending from the upper deflecting units 728. The shaft 736 and collar 738 are represented as being integral portions of their respective deflecting units 728, though it is also foreseeable that the shaft 736 and collar 738 may be separately fabricated and assembled to their respective deflecting units 728. The coupling 734 is further represented as comprising a set screw 740 for preventing rotation of the shaft 736 in the collar 738, such that the deflecting units 728 are rigidly coupled together. As such, the deflecting units 728 are capable of being simultaneously operated (rotated) in unison with each other, such that the deflection imposed by the cams 732 of the upper deflecting units 728 in the upper portions of the cutting tools 512 may be the very same as the deflection induced by the cams 732 of the corresponding lower deflecting units 728 in the lower portions of the cutting tools 512. Even so, loosening the set screws 740 serves to decouple the deflecting units 728, such that the units 728 are independently adjustable (rotatable) relative to each other so that the deflection induced by the cams 732 of the upper deflecting units 728 in the upper portions of the cutting tools 512 can be intentionally different from the deflection induced by the cams 732 of the corresponding lower deflecting units 728 in the lower portions of the cutting tools 512, for example, as previously described in reference to FIGS. 14 and 15. Whereas FIGS. 18 and 19 depict the use of set screws 740, other means for coupling and decoupling the deflecting units 728 are also within the scope of the disclosure, for example, shaft collars, tapered drives, press fit assemblies, etc. Other than the above-noted features, the cutting head 710 of FIGS. 17 to 19 may be identical to the cutting heads 510 and 610 of FIGS. 12 to 16.

Figure 20:
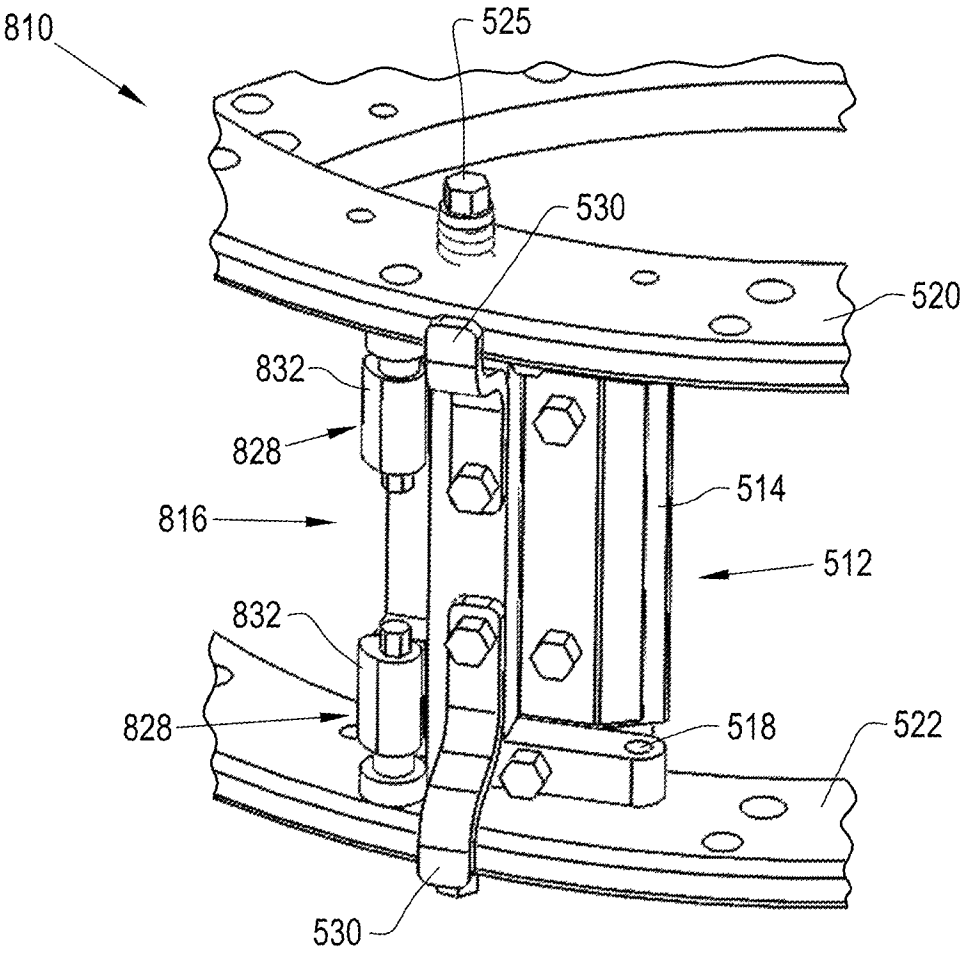
FIG. 20 is a perspective view showing a fragment of a cutting head for cutting food products in accordance with an additional nonlimiting embodiment of the disclosure, including a pair of mounting frames and a cutting tool pivotally mounted to the mounting frames, but lacking a control ring for pivoting the cutting tool relative to the mounting frames.

FIG. 20 depicts a portion of a cutting head 810 that, similar to the embodiment of FIGS. 12 to 15, comprises an adjustment mechanism 816 that utilizes deflecting units 828 that are not directly coupled together. Additionally, the cutting head 810 does not include any other means by which the deflecting units 828 are coupled, for example, such means as the control rings 536 of FIGS. 12 to 15, the rods 634 of FIG. 16, or the couplings 734 of FIGS. 17 to 19. Instead, the deflecting units 828 are mounted to be independently operated (rotated) relative to their respective mounting frames 520 and 522, such that the units 828 are independently adjustable (rotatable) relative to each other so that the deflection induced by the cams 832 of the upper deflecting units 828 in the upper portions of the cutting tools 512 can be intentionally different from the deflection induced by the cams 832 of the corresponding lower deflecting units 828 in the lower portions of the cutting tools 512, for example, as previously described in reference to FIGS. 14, 15, and 17 to 19. Otherwise, the cutting head 810 of FIG. 20 may be identical to the cutting heads 510, 610, and 710 of FIGS. 12 to 19.

Figure 21:
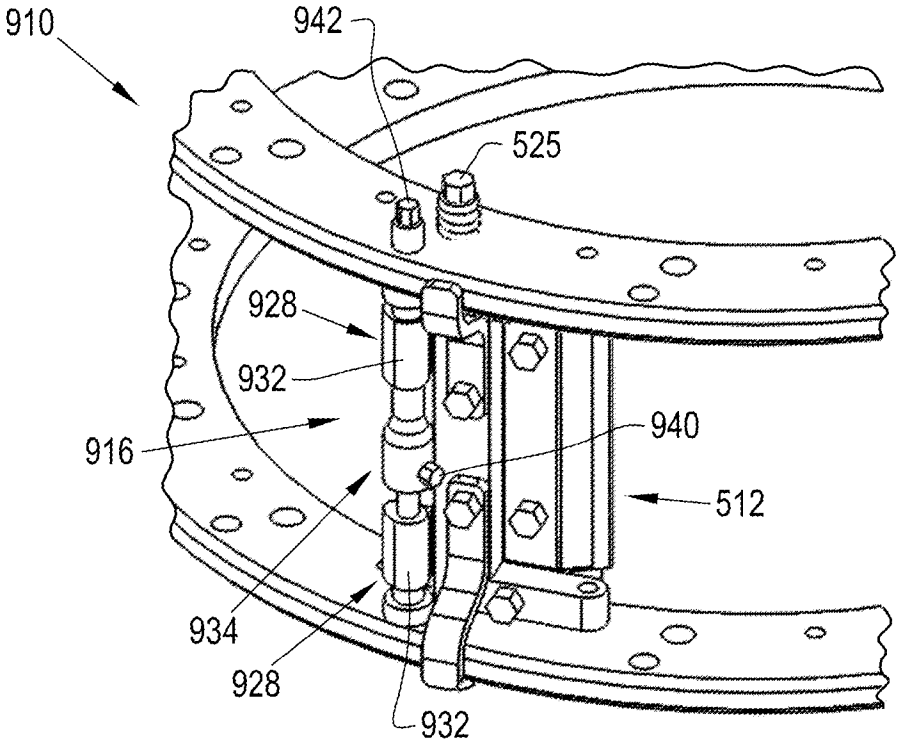
FIGS. 21 and 22 are perspective views showing a fragment of a cutting head and the entire cutting head for cutting food products in accordance with another nonlimiting embodiment of the disclosure.
Figure 22:
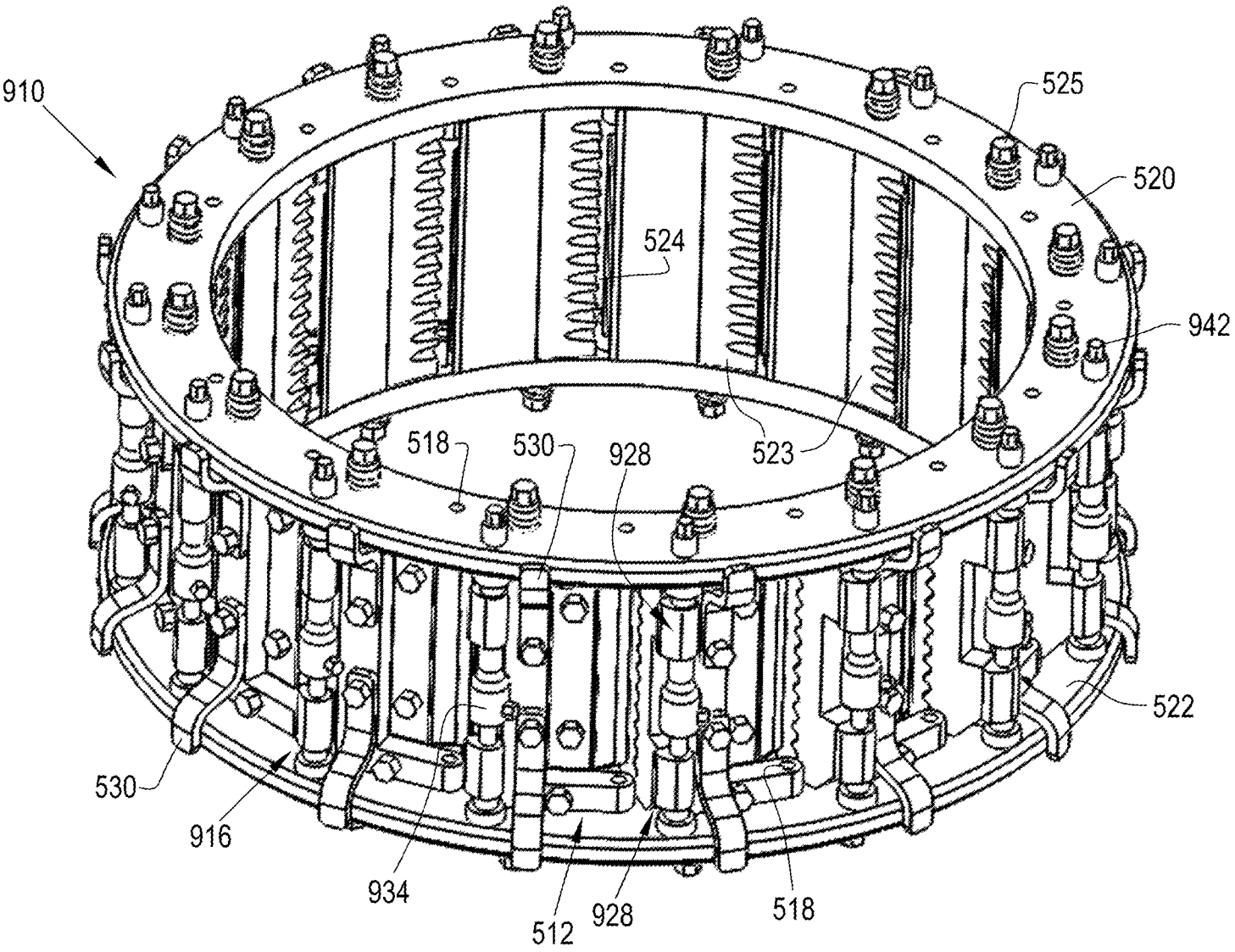

FIGS. 21 and 22 depict, respectively, a portion of a cutting head 910 and a complete cutting head 910 that, similar to the embodiment of FIG. 20, does not include control rings for coupling deflecting units 928 of an adjustment mechanism 916 of the cutting head 910. Instead, the deflecting units 928 are directly coupled together with couplings 934, which in the nonlimiting embodiment of FIGS. 21 and 22 are identical to the couplings 734 shown for the embodiment of FIGS. 17 to 19. As such, the deflecting units 928 associated with an individual cutting tool 512 are capable of being simultaneously operated (rotated) in unison with each other, such as with the hexagonal heads 942 shown, but independently operated relative to the deflecting units 928 associated with other cutting tools 512 of the cutting head 910. The deflection imposed by cams 932 of the upper deflecting units 928 in the upper portions of the cutting tools 512 may be the very same as the deflection induced by cams 932 of the corresponding lower deflecting units 928 in the lower portions of the cutting tools 512. Loosening a set screw 940 serves to decouple the deflecting units 928 associated with an individual cutting tool 512, such that the units 928 are independently adjustable (rotatable) relative to each other and the deflection induced by the cams 932 of the upper deflecting units 928 in the upper portions of the cutting tools 512 can be intentionally different from the deflection induced by the cams 932 of the corresponding lower deflecting units 928 in the lower portions of the cutting tools 512, for example, as previously described in reference to FIGS. 14 and 15. Other than the above-noted features, the cutting head 910 of FIGS. 21 and 22 may be identical to the cutting heads 510, 610, 710, and 810 of FIGS. 12 to 20.

Figure 23:
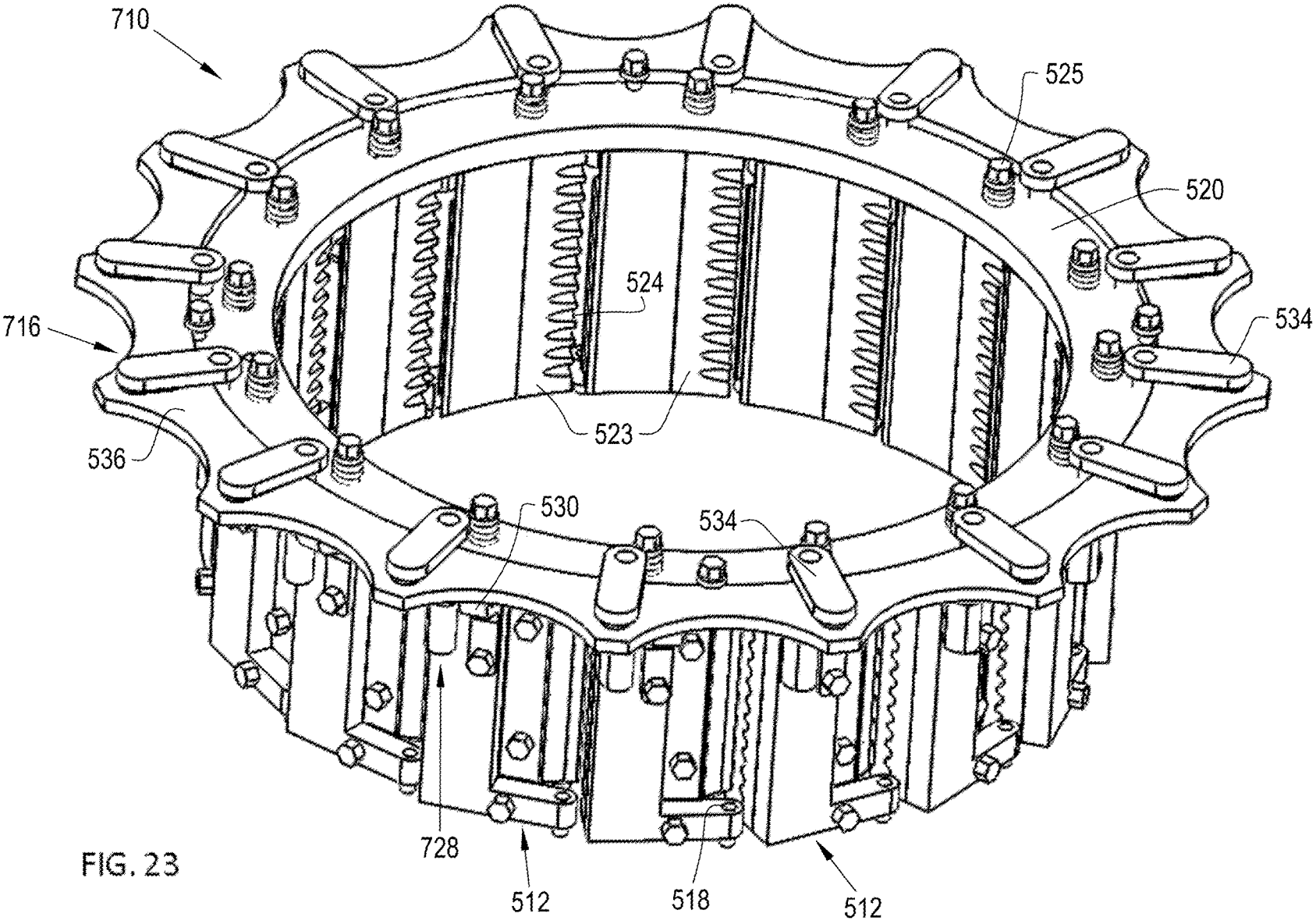
FIG. 23 is a perspective view of a modified embodiment of the cutting head of FIG. 17 in accordance with another nonlimiting embodiment of the disclosure.

In the absence of the lower control ring 536 and lower set of levers 534 in the embodiments of FIGS. 17 through 22, it is foreseeable that the lower mounting frame 522 may be omitted in these embodiments, in which case the cutting tools 512 and their deflecting units 528 could assemble directly onto a support frame of a machine (e.g., the slicing machine 150 of FIG. 7). Furthermore, such an embodiment may also omit the lower deflecting units 528, resulting in the cutting head (for example, 710 of FIG. 17) having a configuration as represented in FIG. 23.

Figure 24:
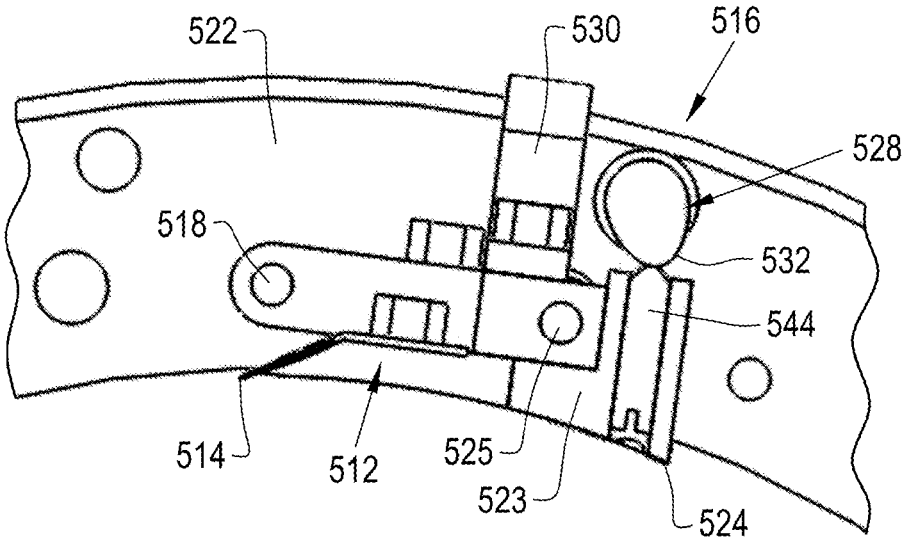
FIGS. 24, 25, and 26 are top plan views that schematically depict different means by which zero positions of cutting tools of any of FIGS. 12 through 23 can be adjusted with set screws in accordance with additional nonlimiting embodiments of the disclosure.
Figure 25:
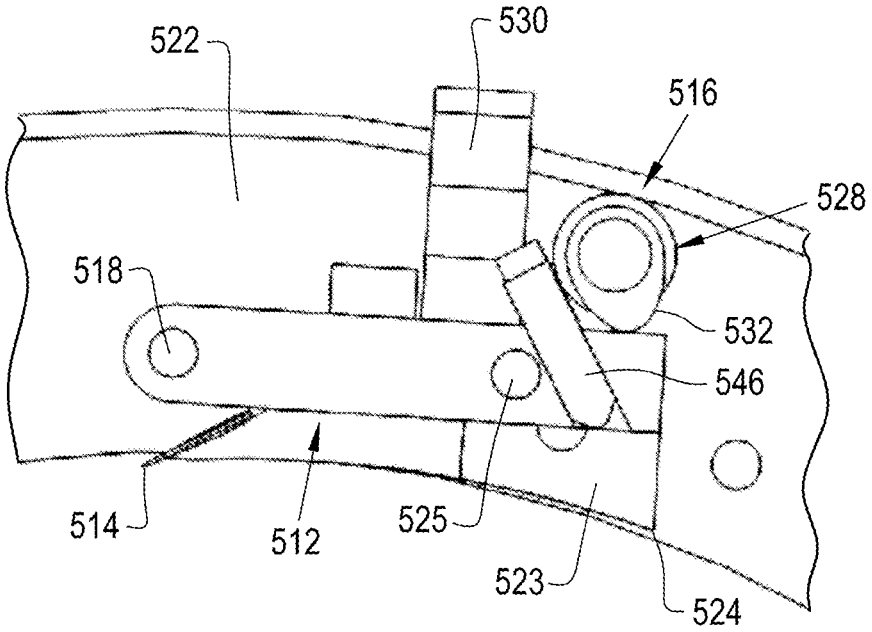
Figure 26:
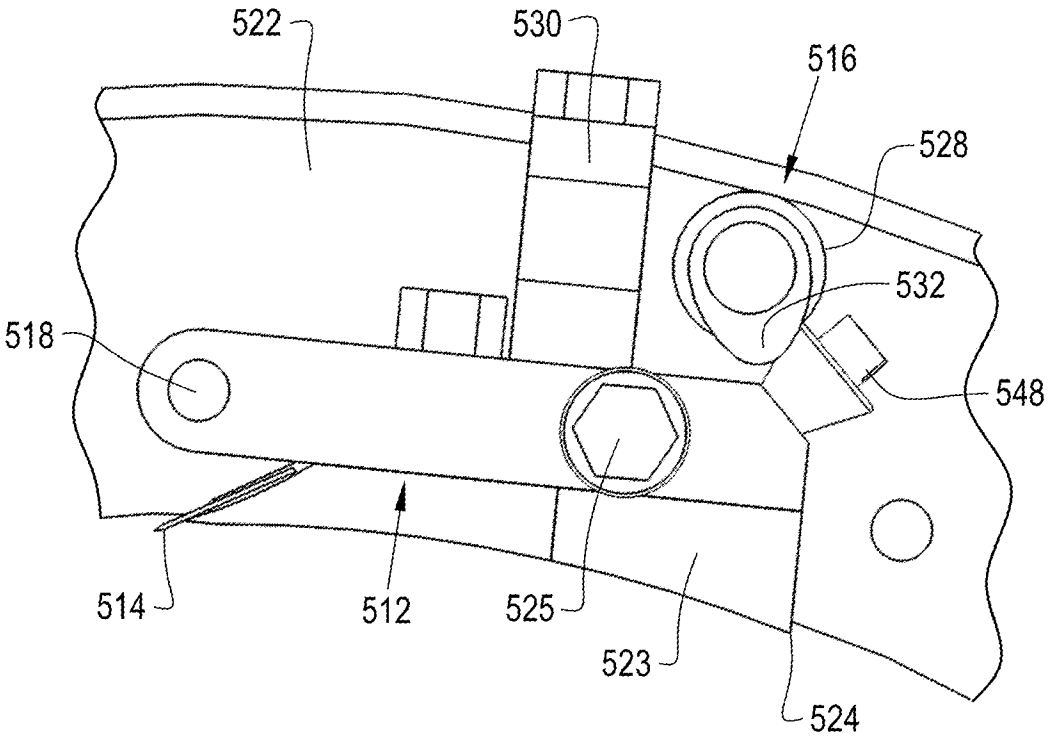

Whereas the adjustment mechanisms 516, 616, 716, 816, and 916 are depicted as utilizing cams associated with the deflecting units 528, 728, 828, and 928, it is foreseeable that at least some of the cams could be replaced by or supplemented with other means capable of deflecting the cutting tools 512 about their pivot axes defined by the pivot pins 518, for example, levers, set screws, shims, etc., that may be implemented with deflecting units mounted to the mounting frames 520 and 522 and operated with the levers 534 and/or control rings 536. As such, the adjustment mechanisms 516, 616, 716, 816, and 916 should be broadly understood to encompass means in addition to or other than cams that are capable of deflecting the cutting tools 512 in unison or independently, as was described above. As nonlimiting examples, FIGS. 24, 25, and 26 depict alternative embodiments in which the cams 532 of the types depicted in FIGS. 12 through 22 are supplemented with set screws. In FIG. 24, each cam 532 contacts a set screw 544 (of which one is shown in FIG. 24) threaded through the gate 523 to adjust a zero point of adjustment for each cam 532, and in so doing the zero points of the radial deflection distances of the portions of the cutting tools 512 engaged by the cams 532. In FIG. 25, one or more set screws 546 (of which one is shown in FIG. 25) are threaded into the cutting tool 512 and engage the gate 523 to force the gate 523 and its trailing edge 524 radially inward, thus adjusting the gate opening 526 independent of and in addition to the cams 532. In FIG. 26, off-axis set screws 548 with tapered heads (of which one is shown in FIG. 26) are threaded into the cutting tool 512 so that each cam 532 contacts the tapered head of one of the set screws 548 to adjust a zero point of adjustment for each cam 532, and in so doing the zero points of the radial deflection distances of the portions of the cutting tools 512 engaged by the cams 532. In at least FIGS. 24 and 26, the portions of the cutting tools 512 engaged by the cams 532 are defined by the set screws 544, 546, or 548, instead of the body of the cutting tools 512. Though set screws are convenient structures for the functions described above for FIGS. 24-26, it is foreseeable that levers, cams, or other means could be adopted to provide an adjustment or modification capability relating to the portions of the cutting tools 512 engaged by the cams 532 or the ability to selectively and independently alter the positions of the trailing edges of the cutting tools 512.

Furthermore, various means may be utilized to rotate the outer rings 40, 240, and 430 and control rings 536 as input sources to the deflecting units 528, 728, 828, and 928. For example, actuators, gears, etc., could be used as manually-controlled or computer-controlled inputs to automate the operation of the deflecting units 528, 728, 828, and 928.

While the disclosure has been described in terms of particular embodiments, it should be apparent that alternatives could be adopted by one skilled in the art. For example, the cutting heads, their components, and the apparatuses in which they are installed could differ in appearance and construction from the embodiments described herein and shown in the drawings, functions of certain components of the cutting head 10 could be performed by components of different construction but capable of a similar (though not necessarily equivalent) function, and appropriate materials could be substituted for those noted. As such, it should be understood that the above detailed description is intended to describe the particular embodiments represented in the drawings and certain but not necessarily all features and aspects thereof, and to identify certain but not necessarily all alternatives to the represented embodiments and their described features and aspects. As a nonlimiting example, the disclosure encompasses additional or alternative embodiments in which one or more features or aspects of a particular embodiment could be eliminated or two or more features or aspects of different embodiments could be combined. Accordingly, it should be understood that the disclosure is not necessarily limited to any embodiment described herein or illustrated in the drawings, and the phraseology and terminology employed above are for the purpose of describing the illustrated embodiments and do not necessarily serve as limitations to the scope of the disclosure. Finally, while the appended claims recite certain aspects believed to be associated with the invention, they do not necessarily serve as limitations to the scope of the invention.

The invention claimed is:

1. An apparatus for cutting food products, the apparatus having an annular-shaped cutting head comprising:

at least a first mounting frame surrounding a central axis of the cutting head;

a plurality of cutting tools arranged around the central axis and pivotably coupled to the first mounting frame such that each of the cutting tools has a pivot axis;

first deflecting units engaging first portions of the cutting tools in proximity to the first mounting frame to deflect the first portions a first radial deflection distance relative to the central axis;

second deflecting units engaging second portions of the cutting tools to deflect the second portions a second radial deflection distance relative to the central axis, the second portions of the cutting tools engaged by the second deflecting units being spaced apart from the first portions of the cutting tools and being positioned farther from the first mounting frame than the first portions such that the first deflecting units and the second deflecting units associated with one of the cutting tools make discontinuous contact with the cutting tool; and an adjustment mechanism that includes at least one lever to alter the first radial deflection distance and the second radial deflection distance of the first portions and the second portions of the cutting tools, respectively, wherein the adjustment mechanism is operable to alter the first radial deflection distances in unison with each other and the second radial deflection distances in unison with each other.

2. The apparatus of claim 1, wherein the cutting tools define sequential pairs of the cutting tools in which one of the cutting tools of each sequential pair is a leading cutting tool of the sequential pair and an adjacent one of the cutting tools is a trailing cutting tool of the sequential pair, each of the cutting tools having a cutting blade positioned at a leading side of the cutting tool and a trailing edge positioned at a trailing side of the cutting tool opposite the leading side, the trailing edge of each of the leading cutting tools cooperating with the cutting blade of the trailing cutting tool thereof to define a cutting gap therebetween, each of the cutting tools being rotatable about the pivot axes thereof between a first rotational position in which the cutting gap has a first gap width and a second rotational position in which the cutting gap has a second gap width that is different from the first gap width.

3. The apparatus of claim 2, wherein the second gap width is less than the first gap width such that the cutting head is configured to produce slices of the food products that are thinner when the cutting tools are positioned at the second rotational positions thereof than when the cutting tools are positioned at the first rotational positions thereof.

4. The apparatus of claim 2, wherein the trailing edges of the cutting tools are located a first radial distance from the central axis when the cutting tools are positioned at the first rotational positions and are located a second radial distance from the central axis when the cutting tools are positioned at the second rotational positions, wherein the second radial distance is less than the first radial distance.

5. The apparatus of claim 2, wherein the first deflecting units and the second deflecting units each engage the trailing sides of the cutting tools, and the pivot axis of each of the cutting tools is located adjacent the cutting blade of the cutting tool thereof.

6. The apparatus of claim 1, further comprising a second mounting frame surrounding the central axis of the cutting head and spaced apart from the first mounting frame along the central axis, wherein the cutting tools are disposed between and pivotably coupled to the first mounting frame and the second mounting frame, and the second deflecting units engage the second portions of the cutting tools in proximity to the second mounting frame.

7. The apparatus of claim 1, further comprising a biasing member to maintain engagement of the cutting tools with the first deflecting units and the second deflecting units, wherein the first deflecting units and the second deflecting units are formed to serve as adjustable stops for the cutting tools.

8. The apparatus of claim 7, wherein the a biasing member biases the cutting tools radially outward away from the central axis to maintain engagement of the first deflecting units and the second deflecting units with the first portions and the second portions of the cutting tools, respectively.

9. The apparatus of claim 8, wherein the biasing member is connected to the cutting tools and engages at least the first mounting frame.

10. The apparatus of claim 1, wherein the first deflecting units and the second deflecting units each comprise a cam that is rotatable about a camming axis between a first camming position in which the cutting tools are located at a first rotational position and a second camming position in which the cam deflects the cutting tools toward a second rotational position.

11. The apparatus of claim 10, wherein the cams of the first deflecting units and the second deflecting units are independently rotatable about the cam axes thereof and operable to deflect the first portions and the second portions of the cutting tools so that the first radial deflection distance and the second radial deflection distance are capable of being different.

12. The apparatus of claim 10, wherein the cams of the first deflecting units and the second deflecting units are coupled to rotate in unison about the camming axes thereof and are operable to deflect the first portions and the second portions of the cutting tools.

13. The apparatus of claim 12, further comprising a coupler configured to couple and decouple the cams of the first deflecting units and the second deflecting units so that the cams are capable of being independently rotated about the cam axes thereof and operable to deflect the first portions and the second portions of the cutting tools so that the first radial deflection distance and second radial deflection distance are capable of being different.

14. The apparatus of claim 1, wherein the first deflecting units and the second deflecting units are coupled to operate in unison to deflect the first portions and the second portions of the cutting tools, and the deflection operating system comprises levers coupled to the first deflecting units and operable to rotate the first deflecting units and the second deflecting units in unison to deflect the first portions and the second portions of the cutting tools.

15. The apparatus of claim 14, further comprising a coupler configured to couple and decouple the first deflecting units and the second deflecting units so that the first deflecting units and the second deflecting units are capable of being independently rotated to deflect the first portions and the second portions of the cutting tools so that the first radial deflection distance and the second radial deflection distance are capable of being different.

16. The apparatus of claim 14, wherein the adjustment mechanism further comprises a control ring having an axis of rotation about the central axis, the control ring being coupled to the levers to rotate the first deflecting units and the second deflecting units in unison.

17. The apparatus of claim 16, wherein the control ring is coupled to the levers so as to be secured by the levers to one of the upper mounting frame or the lower mounting frame.

18. The apparatus of claim 1, further comprising a fastener to secure the first mounting frame and the cutting tools together, and a biasing member configured to apply a load to hold the first mounting frame against the cutting tools while still allowing the cutting tools to move relative to the first mounting frame when the first deflecting units and the second deflecting units are operated.

19. An apparatus for cutting food products, the apparatus having an annular-shaped cutting head comprising:

a first mounting frame and a second mounting frame surrounding a central axis of the cutting head and spaced apart along the central axis;

a plurality of cutting tools arranged around the central axis and disposed between and pivotably coupled to the first mounting frame and the second mounting frame such that each of the cutting tools has a pivot axis, the cutting tools defining sequential pairs of the cutting tools in which one of the cutting tools of each of the sequential pairs is a leading cutting tool of the sequential pair and an adjacent cutting tool is a trailing cutting tool of the sequential pair, each of the cutting tools having a cutting blade positioned at a leading side of the cutting tool and a trailing edge positioned at a trailing side of the cutting tool opposite the leading side, the trailing edge of each of the leading cutting tools cooperates with the cutting blade of the trailing cutting tool thereof to define a cutting gap therebetween, the cutting tools each being rotatable about the pivot axes thereof between a first rotational position in which the cutting gap has a first gap width and a second rotational position in which the cutting gap has a second gap width that is different from the first gap width;

first camming units each coupled to the first mounting frame and engaging the first portions of the cutting tools located in proximity to the first mounting frame to deflect the first portions a first radial deflection distance relative to the central axis;

second camming units coupled to the second mounting frame and engaging the second portions of the cutting tools located in proximity to the second mounting frame to deflect the second portions a second radial deflection distance relative to the central axis, a biasing member configured to maintain engagement of the cutting tools with the first camming units and the second camming units, wherein the first camming units and the second camming units serve as adjustable stops for the cutting tools; and an adjustment mechanism configured to enable independent altering of the first radial deflection distance and the second radial deflection distance of the first portions and the second portions of the cutting tools.

20. The apparatus of claim 19, wherein the first camming units and the second camming units are adapted to alter the first radial deflection distances in unison with each other and alter the second radial deflection distances in unison with each other.

21. The apparatus of claim 20, wherein the first camming units and the second camming units are adapted to alter the first radial deflection distances and the second radial deflection distances in unison with each other.

22. The apparatus of claim 19, wherein the first camming units and the second camming units are is further adapted to alter the first radial deflection distances and the second radial deflection distances of each individual cutting tool of the cutting tools in unison with each other.

23. The apparatus of claim 19, further comprising a fastener to secure the first mounting frame, the second mounting frame, and the cutting tools together, and a biasing member formed to apply a load to hold the first mounting frame and the second mounting frame against the cutting tools while still allowing the cutting tools to move relative to the first mounting frame and the second mounting frame when the first camming units and the second camming units are operated.

24. A method of operating an apparatus to cut food products, the apparatus having an annular-shaped cutting head comprising at least a first mounting frame surrounding a central axis of the cutting head and a plurality of cutting tools arranged around the central axis of the cutting head and pivotably coupled to the first mounting frame such that each of the cutting tools has a pivot axis, the method comprising:

deflecting each of the cutting tools about the pivot axis thereof by engaging first portions of the cutting tools in proximity to the first mounting frame to deflect the first portions a first radial deflection distance relative to the central axis and separately engaging second portions of the cutting tools to deflect the second portions a second radial deflection distance relative to the central axis, the second portions of the cutting tools being spaced apart from the first portions of the cutting tools and farther from the first mounting frame than the first portions; and altering the first radial deflection distances and the second radial deflection distances of the first portions and second portions of the cutting tools, wherein at least some of the first radial deflection distances and the second radial deflection distances are altered in unison with each other.

25. The method of claim 24, wherein the altering step further comprises altering the first radial deflection distances in unison with each other and altering the second radial deflection distances in unison with each other.

26. The method of claim 25, wherein the altering step further comprises altering the first radial deflection distances and the second radial deflection distances in unison with each other.

27. The method of claim 25, wherein the altering step further comprises altering the first radial deflection distances independently of the second radial deflection distances.

28. The method of claim 24, wherein the altering step further comprises altering the first radial deflection distances and the second radial deflection distances of each individual cutting tool of the cutting tools in unison with each other.

29. The method of claim 24, further comprising securing the first mounting frame and the cutting tools together, and applying a load that holds the first mounting frame against the cutting tools while still allowing the cutting tools to move relative to the first mounting frame during the deflecting step.

* * * * *